US007922165B2

(12) United States Patent
Kamiya

(10) Patent No.: US 7,922,165 B2
(45) Date of Patent: Apr. 12, 2011

(54) SHEET STACKING APPARATUS, SHEET PROCESSING APPARATUS AND IMAGE FORMING APPARATUS

(75) Inventor: Daisaku Kamiya, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 309 days.

(21) Appl. No.: 12/265,211

(22) Filed: Nov. 5, 2008

(65) Prior Publication Data

US 2009/0127764 A1 May 21, 2009

(30) Foreign Application Priority Data

Nov. 19, 2007 (JP) ..... 2007-299899

(51) Int. Cl.
*B65H 39/00* (2006.01)

(52) U.S. Cl. ..... 270/58.17; 270/58.07; 270/58.27

(58) Field of Classification Search ..... 270/32, 270/37, 58.07, 58.08, 58.11, 58.12, 58.17, 270/58.27

See application file for complete search history.

(56) References Cited

U.S. PATENT DOCUMENTS

| | | | | |
|---|---|---|---|---|
| 5,382,011 | A | 1/1995 | Tani | |
| 6,845,228 | B2 | 1/2005 | Suzuki et al. | 399/407 |
| 6,994,339 | B2 | 2/2006 | Kato et al. | 270/58.12 |
| 7,007,948 | B2 | 3/2006 | Kamiya et al. | 271/221 |
| 7,455,284 | B2 * | 11/2008 | Kotani | 270/58.04 |
| 7,520,505 | B2 * | 4/2009 | Thomas et al. | 271/220 |
| 2006/0239735 | A1 | 10/2006 | Ogata et al. | |
| 2007/0060459 | A1 | 3/2007 | Hayashi | |
| 2007/0069453 | A1 * | 3/2007 | Thomas et al. | 271/207 |
| 2007/0170634 | A1 * | 7/2007 | Kotani | 270/58.04 |
| 2008/0211158 | A1 * | 9/2008 | Fukasawa et al. | 270/1.01 |

FOREIGN PATENT DOCUMENTS

| | | |
|---|---|---|
| JP | 2006-306522 | 11/2006 |
| JP | 2007-76793 | 3/2007 |

* cited by examiner

*Primary Examiner* — Leslie A Nicholson, III

(74) *Attorney, Agent, or Firm* — Fitzpatrick, Cella, Harper & Scinto

(57) ABSTRACT

A sheet processing apparatus or an image forming apparatus has a discharging member which discharges sheets; a stacking member which stacks the discharged sheets; a sheet positioning member, located on the downstream side of the stacking member in the discharging direction, which receives ends of the discharged sheets in a discharging direction of the sheet discharged by the discharging member; and a pressure member having a pressure surface which presses the sheet received by the sheet positioning member toward a stacking surface of the stacking member; wherein at first a downstream side in the discharging direction of the pressing surface presses the discharged sheets toward the stacking surface of the stacking member, and subsequently an upstream side in the discharging direction of the pressing surface presses the discharged sheets toward the stacking surface sequentially.

9 Claims, 19 Drawing Sheets

SHEET STACKING APPARATUS, SHEET PROCESSING APPARATUS AND IMAGE FORMING APPARATUS

BACKGROUND OF THE INVENTION

1. Field of the Invention

The present invention relates to a sheet stacking apparatus which stacks sheets, a sheet processing apparatus which processes sheets stacked on the sheet stacking apparatus, and an image forming apparatus having these apparatuses.

2. Description of the Related Art

Conventionally, as an image forming apparatus which forms an image on a sheet, there is an apparatus which has a sheet processing apparatus. An apparatus main body forms images on sheets, and the sheet processing apparatus puts sheets together into a sheet bundle, binds them and folds them into a booklet. The sheet processing apparatus sequentially receives sheets on a tray, puts the sheets together into a sheet bundle, aligns the same, binds their central portions, pushes the central portions with an pushing member and pushes them into nips of a pair of fold rollers, the pair of fold rollers convey a sheet bundle and fold the sheets (see Japanese Patent Application Laid-Open No. 2007-076793).

The operation of such a conventional sheet processing apparatus will be described based on FIG. 16. As illustrated in FIG. 16, the sheet processing apparatus first aligns a plurality of sheets by a storing guide 803, and binds central portion thereof in the conveying direction using a staple. Then, a pushing member 830 pushes the central portions of the sheet bundle P, and pushes them into a nip of first pair of fold rollers 810*a* and 810*b*. The first pair of fold rollers 810*a* and 810*b* convey the sheet bundle and in this state, the first pair of fold rollers 810*a* and 810*b* fold the sheets and once stop.

The folded portions of the sheets are nipped by a second pair of fold rollers 812*a* and 812*b* which are different from the first pair of fold rollers 810*a* and 810*b*, and move the second pair of fold rollers 812*a* and 812*b* in a direction intersecting with the conveying direction along a crease of the sheets, thereby reinforcing the folding portion. Accordingly, the sheet bundle becomes a center-folded sheet bundle (simply "folded sheet bundle", hereinafter). Then, the folded sheet bundle are conveyed and discharged into a fold bundle tray 840.

As the sheet stacking apparatus, there is proposed an apparatus having a rear end pressure member which prevents a rear end of a stacked sheet from floating from a stacking portion (see Japanese Patent Application Laid-Open No. 2006-306522).

In recent years, image quality level of image forming apparatuses is enhanced, and sheets on which images are formed are diversified. For example, an image can be printed on a special sheet whose surface is worked such as a coated paper, and on a wide grammage (thin and weak paper or thick and hard paper).

However, in a structure in which sheets are aligned by the storing guide 803 whose downstream side in a discharging direction is inclined downward, if the sheets are weak, the sheets (bundle) are folded by their own weight or air is stored in the sheet bundle and as a result, sheets swell in some cases. Not only rear ends of sheets, but also central portions swell in some cases, and this affects the subsequent conveying performance of sheets, and in an apparatus which aligns the sheets, alignment failure may occur.

For example, as illustrated in FIG. 17A, if a rear end area (upstream end in the discharging direction) of a sheet P1 which swelled is pushed against a stacking surface by a pressure member 16 from a vertical direction, the swelling portion near the rear end of the sheet P1 adversely moves to the central portion as illustrated in FIG. 17B. If such a situation occurs, in a structure in which a rear end of the stacked sheet P1 is held by a holding member 11, a sheet P2 which is to be conveyed next can not be conveyed (state illustrated in FIG. 18B) due to a holding failure (state illustrated in FIG. 18A) or the swell in some cases.

To solve this problem, it seems to be a good idea to bring a stacking portion of a sheet into substantially a horizontal attitude so that the apparatus does not receive the influence of its own weight, but the apparatus is increased in size in the lateral direction, and the installation area of the apparatus is increased.

If a plurality of assortment portions (switching members or the like) are provided, sizes of sheets which are conveyed are limited to a predetermined size only.

As illustrated in FIG. 19A, since the position of the switching member 802 is limited, a rear end portion of the stacked sheet P1 and a tip end portion of a sheet P2 which is conveyed next collide against each other and a jam is generated depending upon a size of the sheets.

As illustrated in FIG. 19B, a rear end of a sheet leans on a tip end 802*a*1 of the switching member 802 and this causes the conveying failure.

The present invention provides a sheet stacking apparatus, a sheet processing apparatus and an image forming apparatus capable of stacking and processing various sheets such as weak sheets without causing conveying failure and alignment failure.

SUMMARY OF THE INVENTION

To solve the above problem, typical structures of a sheet stacking apparatus, a sheet processing apparatus and an image forming apparatus includes: a discharging member which is disposed in an upper portion of the sheet stacking apparatus and which discharges sheets; a stacking member which stacks the sheets discharged downward from the discharging member; a sheet positioning member which receives ends of the sheets stacked on a stacking surface of the stacking member; and a pressure member which presses the sheet received by the sheet positioning member toward the stacking surface of the stacking member; wherein the pressure member presses the discharged sheets from the sheet positioning member side sequentially.

According to the present invention, it is possible to align and stack various sheets such as weak sheets without causing conveying failure and alignment failure.

Further features of the present invention will become apparent from the following description of exemplary embodiments with reference to the attached drawings.

DESCRIPTION OF THE EMBODIMENTS

First Embodiment

A first embodiment of a sheet stacking apparatus, a sheet processing apparatus and an image forming apparatus according to the present invention will be described using the drawings.

(Image Forming Apparatus)

Figure 2:
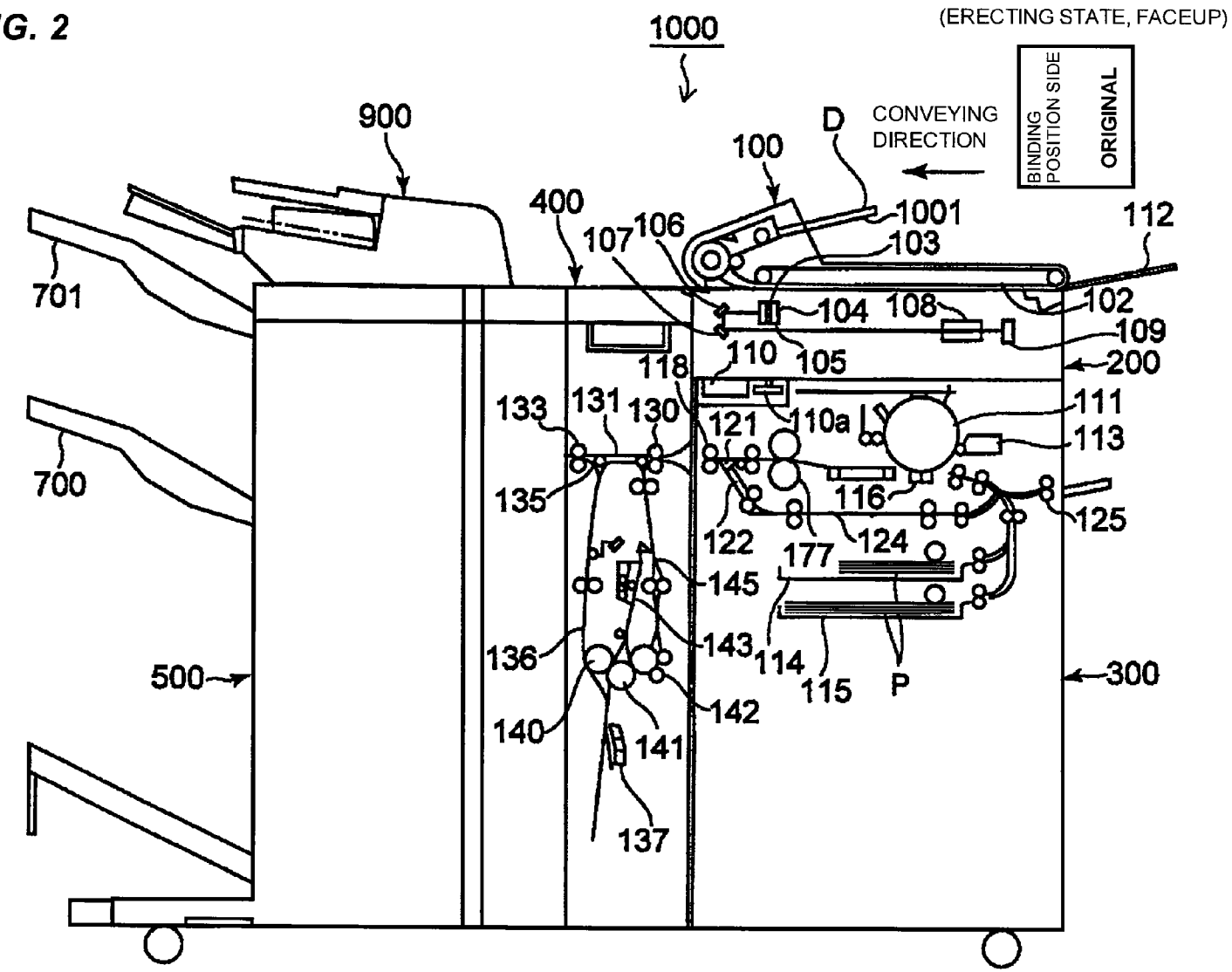
FIG. 2 is a diagram illustrating a structure of an image forming apparatus.

FIG. 2 is a sectional view of the image forming apparatus according to the first embodiment. As illustrated in FIG. 2, a copying machine 1000 as the image forming apparatus includes an original feeding portion 100, an image reader 200, a printing portion 300, a folding processing portion 400, a finisher 500 and an inserter 900. The folding processing portion 400 and the inserter 900 are optional.

Originals are set on a tray 1001 of the original feeding portion 100 in a face-up state (surfaces of the originals on which images are formed are directed up). The binding position of the original is a left end portion of the original. The original which are set on the tray 1001 are conveyed one-sheet by one-sheet sequentially from the top page by the original feeding portion 100 in leftward, i.e., the binding position is set to the leading position. The originals pass through a curved path, the originals are conveyed from left to right on a platen glass 102 and then, they are discharged onto a discharge tray 112. At that time, a scanner unit 104 is stopped at a predetermined original reading position.

The scanner unit 104 reads an image of an original which passes on the scanner unit 104 from left to right. Such a reading method of originals is called "skimming". When an original passes on the platen glass 102, the original is irradiated with light by a lamp 103 of the scanner unit 104. Reflection light from the original is guided to an image sensor 109 through mirrors 105, 106 and 107 and a lens 108.

The image reader 200 can also read an original in such a manner that the original is once stopped on the platen glass 102 by the original feeding portion 100, and the scanner unit 104 is moved from left to right in this state. This reading method is called "fixed reading". When an original is read without using the original feeding portion 100, a user opens and closes the original feeding portion 100, and sets the original on the platen glass 102. Then, the scanner unit 104 carries out the fixed reading.

Image data of the original which was read by an image sensor 109 is subjected to predetermined image processing and is sent to an exposure controlling portion 110. The exposure controlling portion 110 outputs laser light in accordance with an image signal. The laser light is scanned by a polygon mirror 110*a* and is irradiated to a photosensitive drum 111. An electrostatic latent image is formed on the photosensitive drum 111 in accordance with the scanned laser light.

The electrostatic latent image formed on the photosensitive drum 111 is developed by a development device (image forming member) 113, and is visualized as a toner image. Sheets (recording sheets) P are conveyed to a transfer portion 116 from any one of cassettes 114 and 115, a manual feeding portion 125 and a duplex conveying path 124. A visualized toner image is transferred to the sheet in the transfer portion 116. The toner image is fixed to the transferred sheets by a fixing portion 177. The photosensitive drum 111, a development device 113 and the like constitute an image forming portion.

A sheet which passed through the fixing portion 177 is once guided to a path 122 by a switching member 121. If a rear end of the sheet passes through the switching member 121, the sheet is switch-back conveyed and guided to a discharge roller 118 by the switching member 121. With this, the sheets are discharged from the printing portion 300 in a state where a surface of the sheet on which the toner image is formed is directed down (face down). These operations are called "inverse discharge".

If the sheets are discharged out from the apparatus in the face down state, image forming processing can be carried out sequentially from the top page. For example, when the image forming processing is carried out using the original feeding portion 100 or when image data from a computer is subjected the image forming processing, the order of pages can be arranged.

When images are formed on both surfaces of a sheet, the printing portion 300 guides the sheet directly to the discharge roller 118 from the fixing portion 177. The sheet is switch-back conveyed immediately after a rear end of the sheets passed through the switching member 121, and the sheet is guided to the duplex conveying path 124 by the switching member 121.

(Folding Processing Portion 400)

Figure 1:
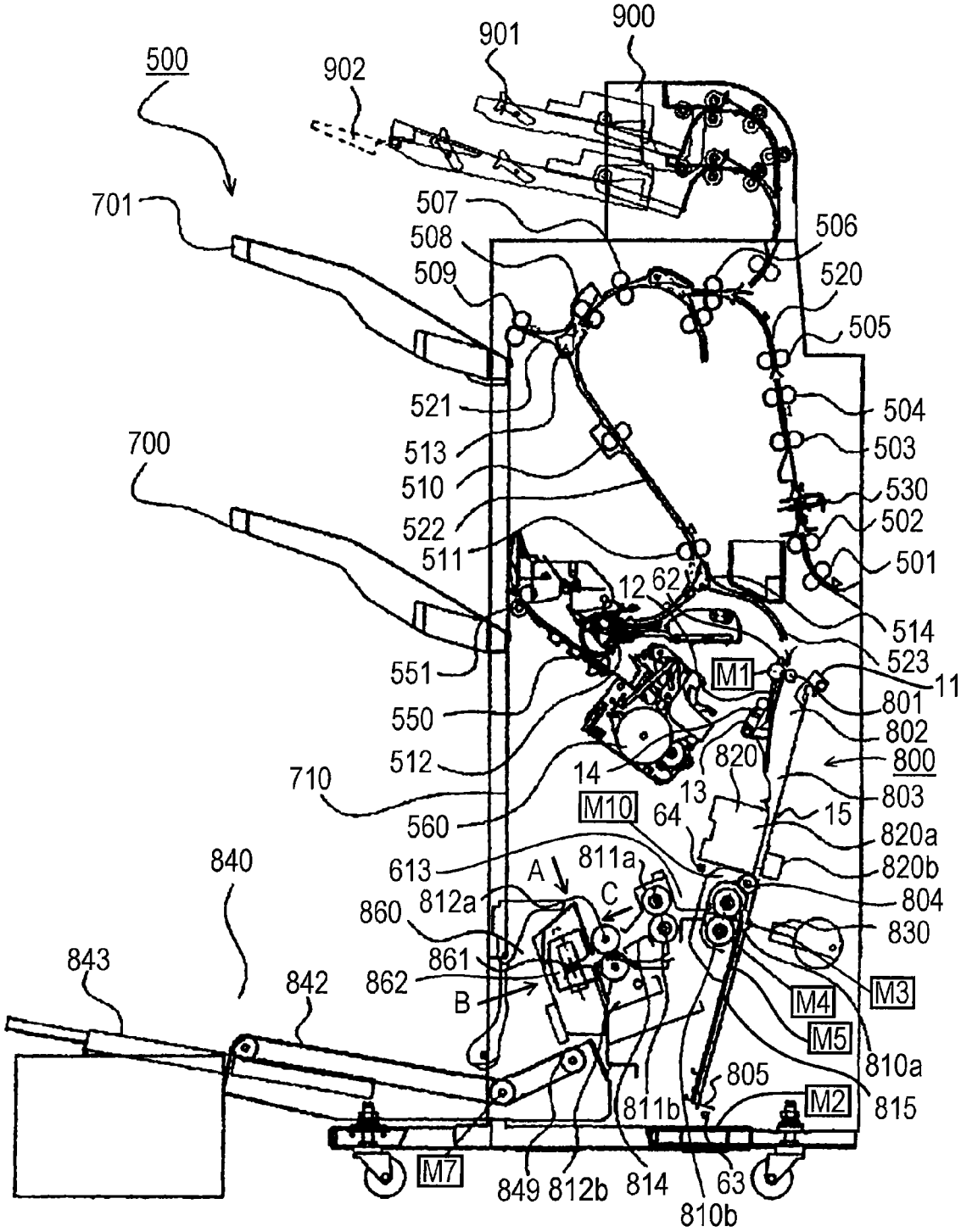
FIG. 1 is a diagram illustrating a structure of a sheet post-processing apparatus having a sheet stacking apparatus according to a first embodiment.

Next, structures of the folding processing portion 400 and the finisher 500 will be described based on FIGS. 1 and 2. FIG. 1 is a sectional view of the finisher 500.

In FIG. 2, the folding processing portion 400 includes a conveying path 131 which receives a sheet discharged from the printing portion 300 and guides the sheet to the finisher 500 side. The conveying path 131 includes a pair of conveying rollers 130 and a pair of discharge rollers 133. The switching member 135 provided near the pair of discharge rollers 133 guides a sheet conveyed by the pair of conveying rollers 130 to the folding path 136 or the finisher 500 side.

When the folding processing of a sheet is carried out, the switching member 135 is switched to the folding path 136 side and guides a sheet to a folding path 136. A tip end of the sheet which was conveyed to the folding path 136 collides against a stopper 137 and a loop is formed and then, the sheet is folded by fold rollers 140 and 141. The loop formed by abutting the folding portion against the upper stopper 143 is further folded by the fold rollers 141 and 142, and the sheet is folded into a Z-shape. The sheet which was folded into the Z-shape is guided through the conveying paths 145 and 131, and is discharged to the finisher 500 by the pair of discharge rollers 133. The folding processing operation by the folding processing portion 400 is selectively carried out.

When the folding processing is not carried out, the switching member 135 is switched to a side where a sheet is guided to the finisher 500. A sheet discharged from the printing portion 300 passes through the conveying path 131 and the switching member 135 and is sent directly to the finisher 500.

(Finisher 500)

The finisher 500 aligns a plurality of sheets conveyed from the printing portion 300 through the folding processing portion 400, and carries out sheet process. Examples of the sheet process include process for bundling a plurality of sheets into a sheet bundle, a staple process (binding process) for stapling rear ends of a sheet bundle, a sorting process and a non-sorting process. The finisher 500 is integrally provided with a center-binding book-forming portion 800 as a sheet stacking apparatus.

As illustrated in FIG. 1, the finisher 500 includes a conveying path 520 through which a sheet conveyed from the folding processing portion 400 is taken into the apparatus. The conveying path 520 is provided with pairs of conveying rollers 502 to 508 in this order from the pair of inlet rollers 501 toward the downstream side in the conveying direction of the sheets.

A punch unit 530 is provided between the pair of conveying rollers 502 and the pair of conveying rollers 503. The punch unit 530 carries out an operation as need arises, and forms a hole (punching process) in a rear end portion of a conveyed sheet.

A switching member 513 is provided at a terminal of the conveying path 520. The switching member 513 switches between an upper discharge path 521 and a lower discharge path 522 connected to a downstream side. The upper discharge path 521 guides a sheet to a sample tray 701 by the upper discharge roller 509. The lower discharge path 522 is provided with pairs of conveying rollers 510, 511 and 512. The pairs of conveying rollers 510, 511 and 512 discharge a sheet to a processing tray 550.

Figure 12:
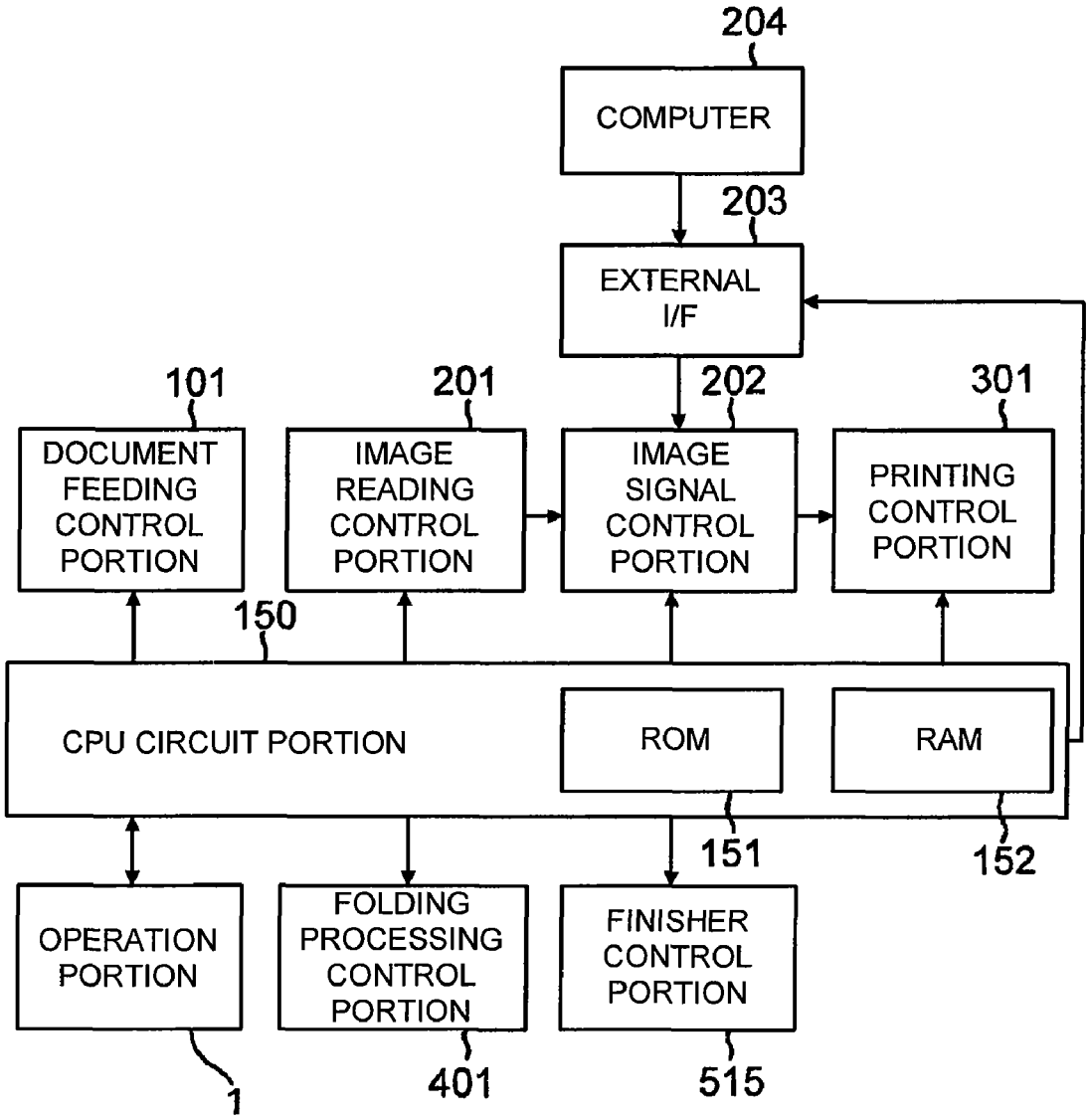
FIG. 12 is a control block diagram of an entire copying machine.

Sheets discharged to the processing tray 550 are sequentially aligned and stacked in a bundle form, and are subjected to an assortment process and a staple process in accordance with setting from an operation portion 1 (FIG. 12). The processed sheet bundles are selectively discharged to a stack tray 700 and the sample tray 701 by the pair of bundle discharge rollers 551.

The staple process is carried out by a stapler 560. The stapler 560 moves in a widthwise direction of a sheet (a direction intersecting with the sheet conveying direction), and binds arbitrary portions of a sheet bundle. The stack tray 700 and the sample tray 701 vertically move along the apparatus main body of the finisher 500. The upper sample tray 701 receives sheets from the upper discharge path 521 and the processing tray 550. The lower stack tray 700 receives sheets from the processing tray 550. A large amount of sheets are stacked on the stack tray 700 and the sample tray 701. Rear ends of the stacked sheets are received by a rear end guide 710 extending vertically, and the sheets are aligned.

(Center-Binding Book-Forming Portion 800)

Next, a structure of the center-binding book-forming portion 800 as the sheet stacking apparatus will be described.

A pair of fold rollers 810 and the pushing member 830 as processing units fold a sheet bundle. In the following description, this folding process of a sheet bundle is called folding process. The folded sheet bundles are creased by a pair of press rollers 861. This process is called creasing processing. In this embodiment, the center-binding book-forming portion 800 is incorporated in the finisher 500 as a sheet processing apparatus having the process function.

A switching member 514 provided at an intermediate portion of the lower discharge path 522 switches a sheet to right, guides the sheet to a saddle discharge path 523, and guides the same to the center-binding book-forming portion 800.

Figure 3:
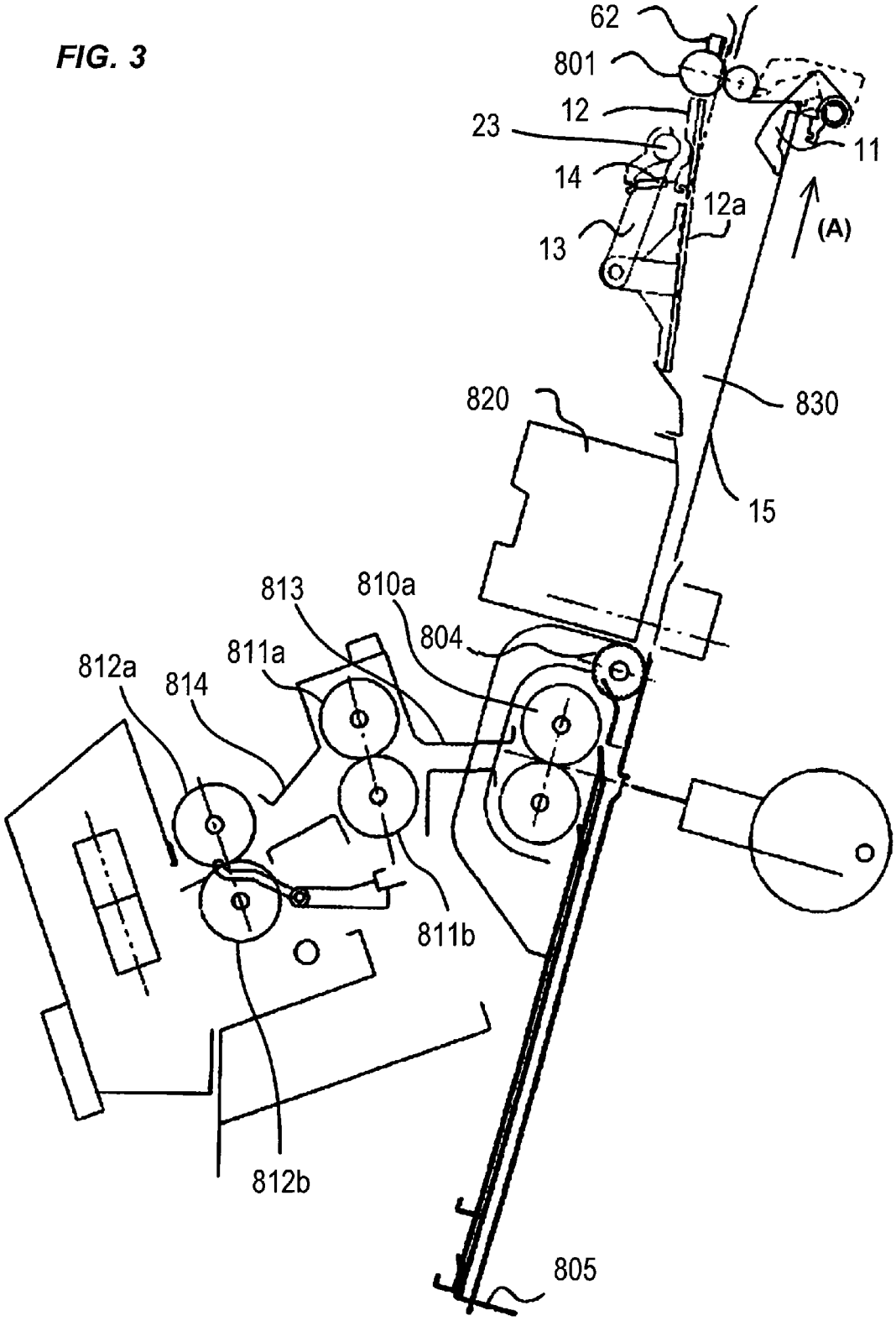
FIG. 3 is a diagram illustrating a structure of a sheet processing apparatus.

As illustrated in FIG. 3, a pair of saddle inlet rollers (discharging member) 801, a pressure member 12, a storing guide (stacking member) 803 which stores a sheet, a conveying roller 804, and a sheet positioning member (restraining member) 805 are disposed in this order in a sheet conveying direction from an inlet of the center-binding book-forming portion 800.

Figure 4:
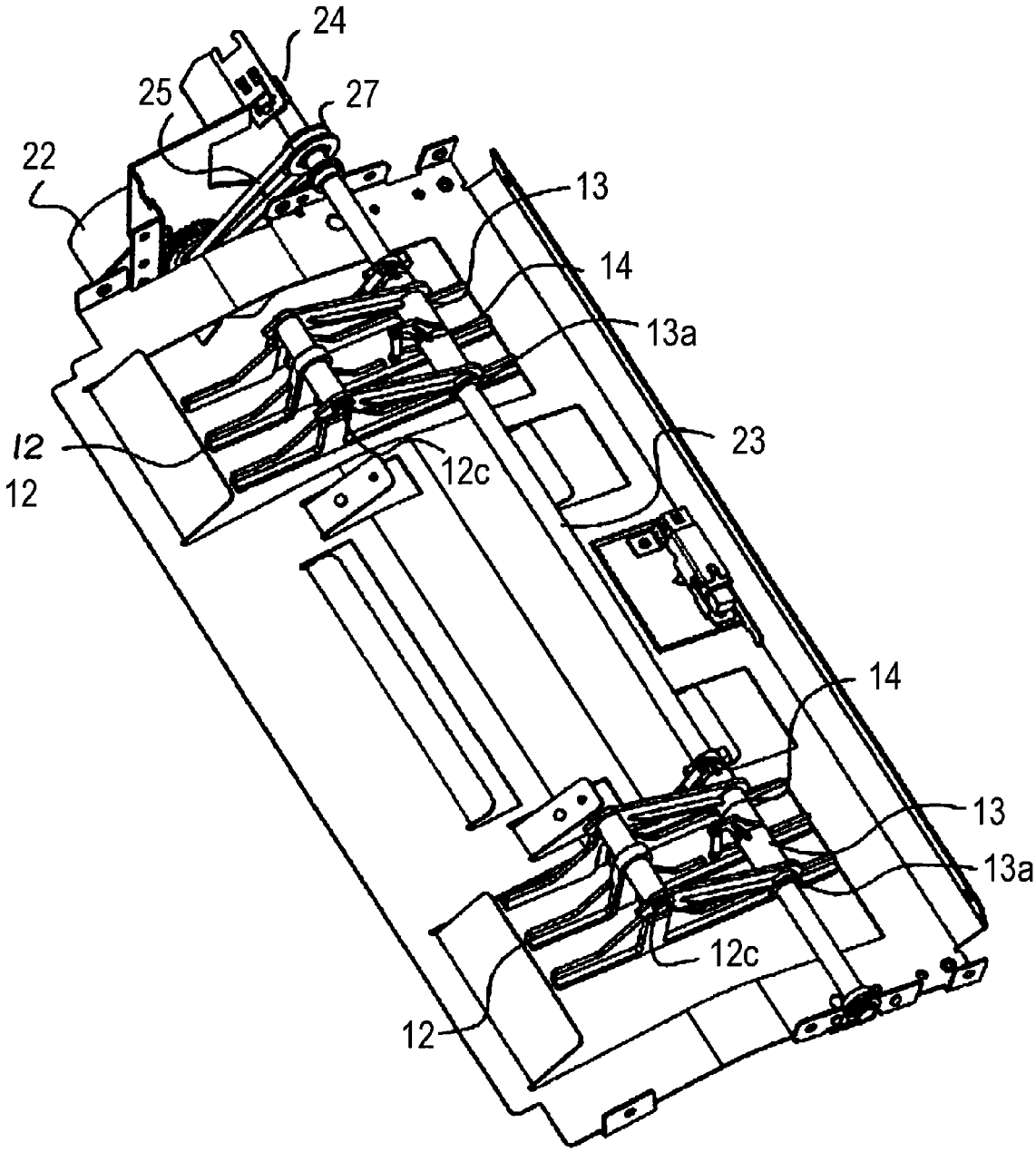
FIG. 4 is a perspective view of the sheet processing apparatus.

As illustrated in FIG. 4, a plurality of pressure members 12 are arranged in a direction intersecting with the sheet conveying direction. The pressure member 12 is supported by a supporting member 13 such that the pressure member 12 can rotate around its rotation shaft 12*c*. One end of the pressure member 12 is applied a force in a direction in which an upstream side thereof in the conveying direction is separated from a paper-passing surface by a spring 14 supported by the supporting member 13, and the one end is locked by a stopper portion 13*a*.

The supporting member 13 is fixedly provided to a turn shaft 23. A pressure member drive motor 22 drives and transmits to the turn shaft 23 through drive transmission members 25 and 27, and makes the pressure member 12 rotate through the supporting member 13. A member position detection sensor (detection member) 24 detects a position of the pressure member 12, and is used for controlling the position of the pressure member 12.

Figure 6A:
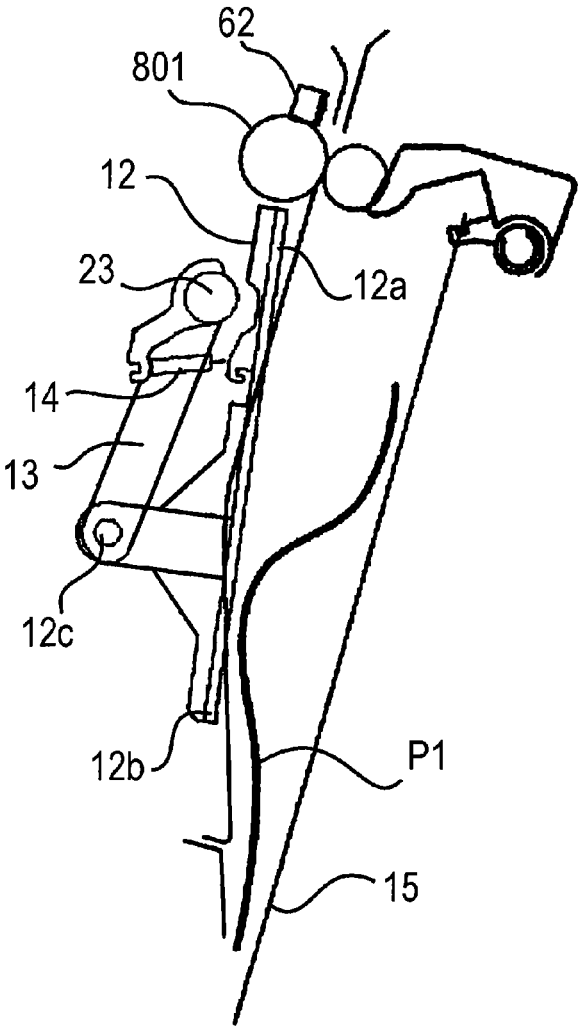
FIGS. 6A and 6B are explanatory diagrams of operation of the sheet processing apparatus.

FIG. 6 are explanatory diagrams of operation of the pressure member 12. As illustrated in FIG. 6A, a sheet P1 stacked on a sheet stacking surface 15 of the storing guide 803 swells as described above.

Figure 6B:
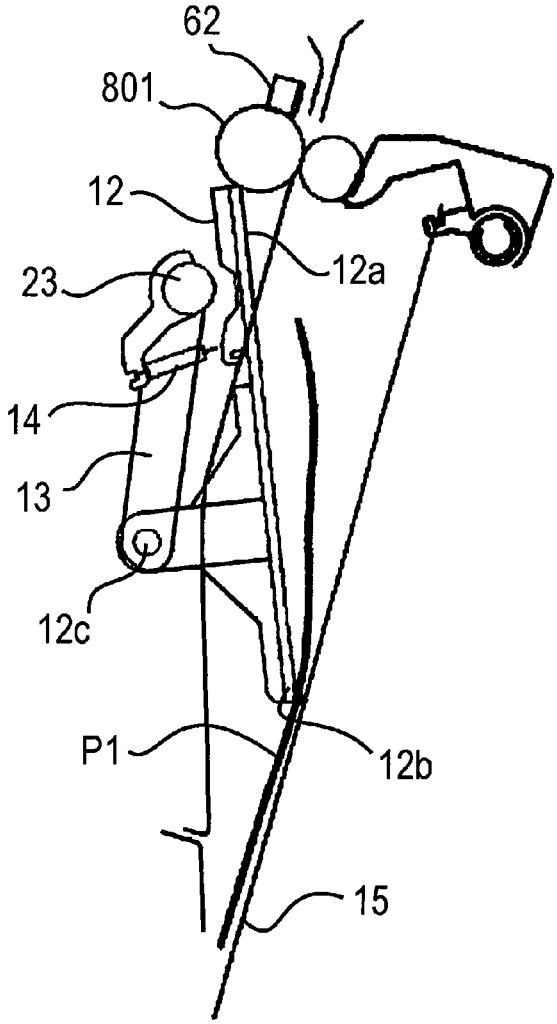

At that time, as illustrated in FIG. 6B, the supporting member 13 and the pressure member 12 start rotating. An upstream side of the pressure member 12 in the conveying direction is pulled up by the spring 14, and a lower portion 12*b* of the downstream side (sheet positioning member 805) in the discharging direction of the pressure member 12 abuts against the sheet P1 first.

Figure 7A:
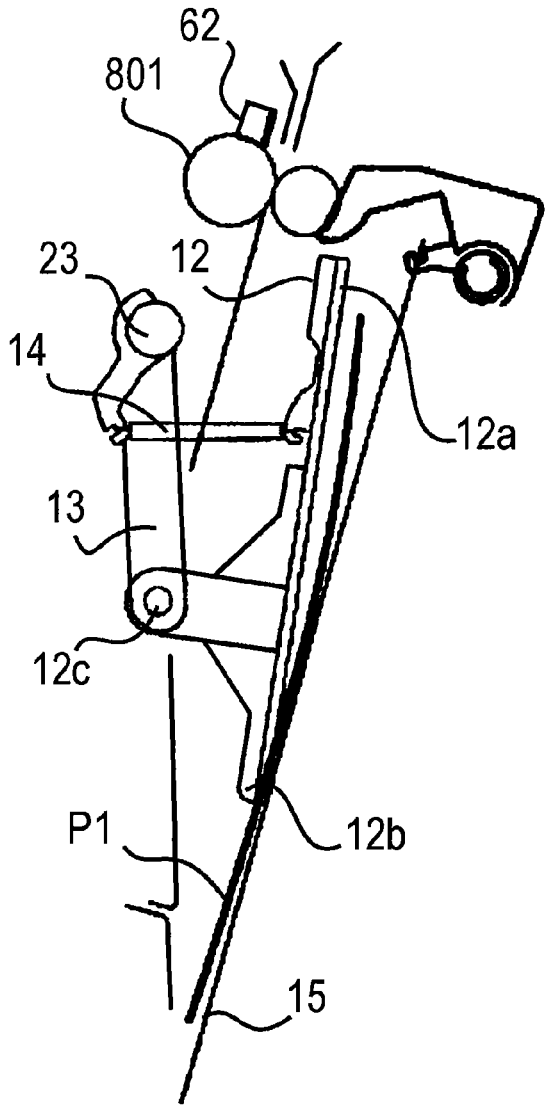
FIGS. 7A and 7B are explanatory diagrams of operation of the sheet processing apparatus.

If the supporting member 13 further rotates as illustrated in FIG. 7A, the pressure member 12 also starts rotating around the rotation shaft 12*c* against a pulling force of the spring 14. Accordingly, the pressure member 12 gradually presses the swell of the sheet upward (opposite side of the sheet positioning member from the sheet positioning member side) from below. If the pressure member 12 presses the sheet from the sheet positioning member, the swell of the sheet moves toward the end portion of the sheet on the opposite side of the sheet positioning member, and the swell disappears.

Figure 7B:
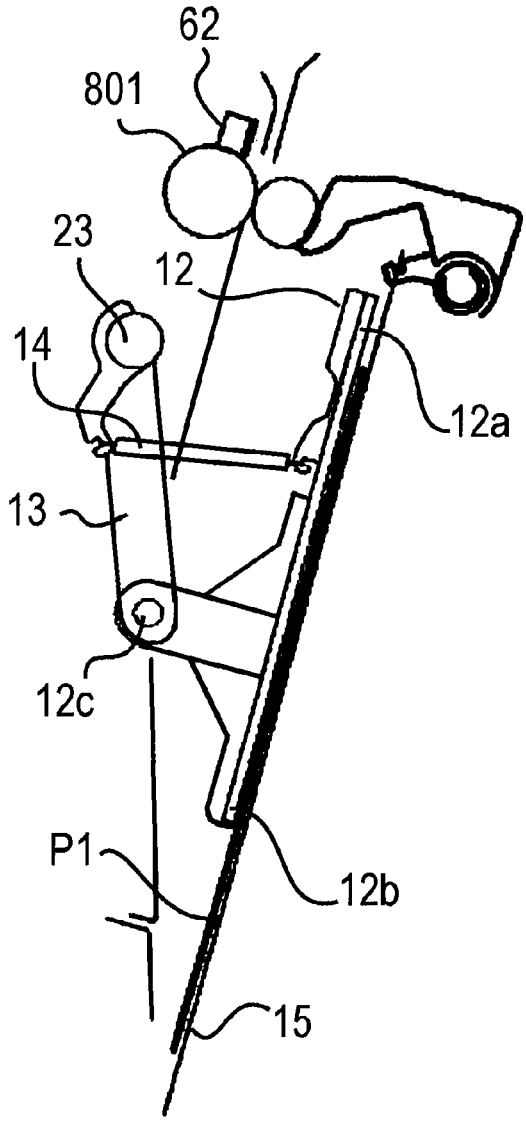

As illustrated in FIG. 7B, if the supporting member 13 further rotates, the pressure member 12 also rotates around the rotation shaft 12*c*, a pressing surface 12*a* nips the sheet P1, applies a force to the sheet p1 toward the sheet stacking surface 15, and presses the sheet P1. This restrains a lower portion of the sheet bundle from swelling.

A holding member 11 is provided above the storing guide 803 which is inclined substantially vertically (75° with respect to the horizontal direction in FIG. 1). The holding member 11 moves in the discharging direction of sheets in accordance with movement of the rear end position of the stacked sheets, and holds upstream ends of the stacked sheets in the discharging direction (rear ends).

A pair of saddle inlet rollers 801 and a conveying roller 804 are rotated by a conveying motor M1. The conveying roller 804 is supported such that the conveying roller 804 can come into contact with and separate from sheets by a driving source (not illustrated), and the conveying roller 804 can come into contact with and separate from sheets with predetermined timing. While the conveying roller 804 is in contact with a sheet, the holding member 11 holds rear ends in the discharging direction of already stacked sheets.

The storing guide 803 is provided at its intermediate portion with a stapler (staple member) 820 which is opposed with the storing guide 803 interposed therebetween. The stapler 820 includes a driver 820*a* which projects a staple, and an anvil 820*b* which folds the projected staple.

The sheet positioning member 805 can receive a downstream end (tip end) of a discharged sheet in the discharging direction when the sheet is conveyed, and can move in the conveying direction such that the central portion of the sheet in the conveying direction is subjected to the staple process. The sheet positioning member 805 is vertically moved by a member moving motor M2 such that the sheet positioning member 805 comes to a binding position of the stapler 820, thereby adjusting the position, and stops at a position suitable for a sheet size.

That is, a position of a rear end of a sheet which abuts against the sheet positioning member 805 and is aligned means that the position is different depending upon sheet size. As illustrated in FIG. 3, the holding member 11 can move in the vertical direction (conveying direction; direction of arrow (A)) in FIG. 3 so that rear ends of stacked sheets having different sizes.

Although the sheet positioning member 805 is disposed such that the downstream end in the discharging direction is received in this embodiment, the invention is not limited to this. For example, the sheet positioning member may be provided upstream in the discharging direction of a stacking member which is inclined such that its upstream end side in the discharging direction becomes lower, and the sheet positioning member may be switched back such that it collides against the sheet positioning member. The sheet positioning member may be provided at a position where an end in a direction intersecting with the discharging direction collides.

(Holding Member 11)

Figure 5:
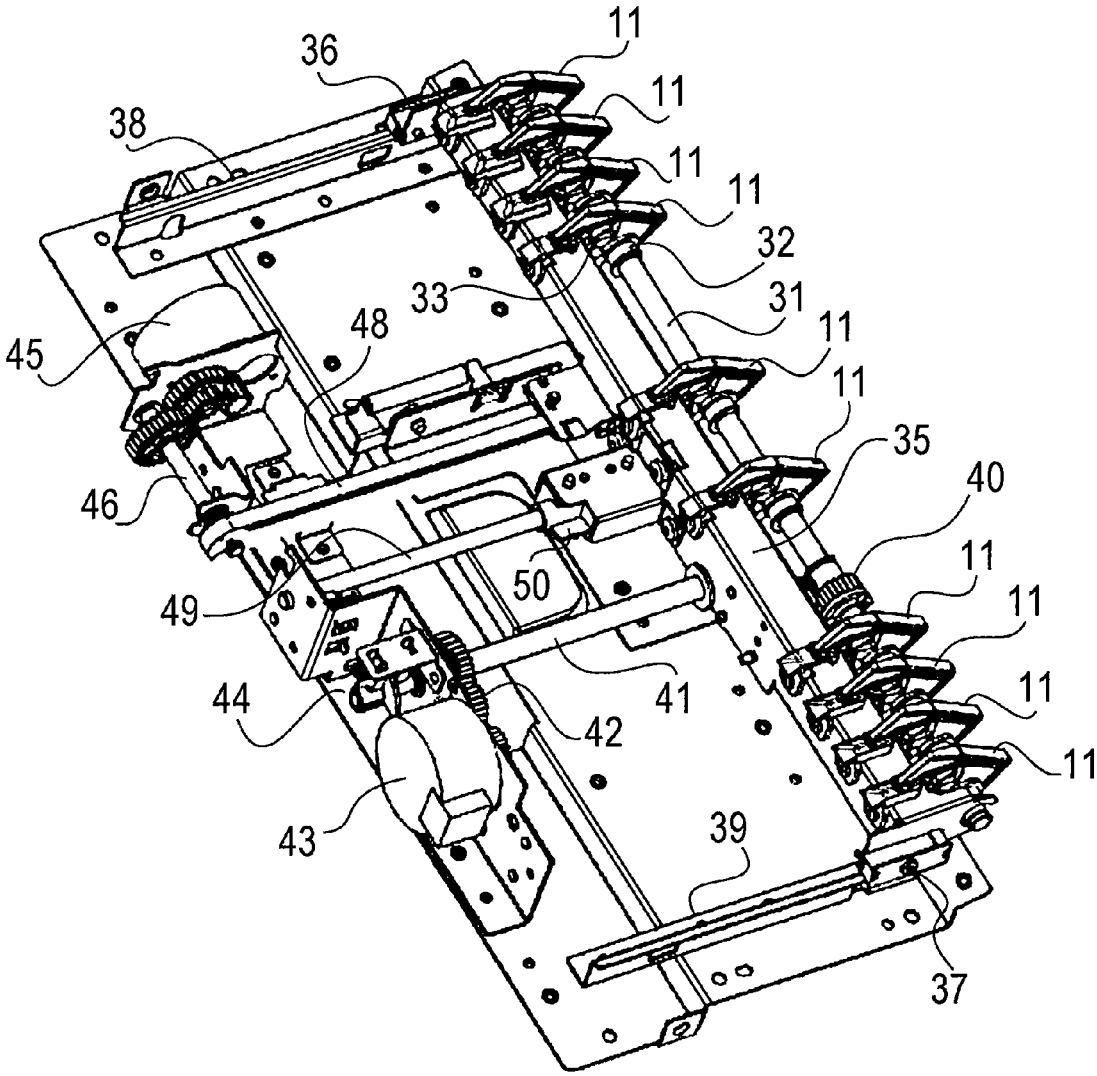
FIG. 5 is a perspective view of the sheet processing apparatus.

The holding member 11 will be described in detail using FIGS. 4 and 5.

The holding member 11 is supported such that it can rotate a predetermined angle with respect to the rotation supporting member 32, and one end of the holding member 11 is applied a force by a pressing spring 33. The pressing spring 33 is supported by the rotation supporting member 32. The rotation supporting member 32 is fixedly provided to a holding member shaft 31. The holding member shaft 31 is supported such that it can rotate with respect to the supporting member 35.

A holding member rotating motor 43 gives a driving force to a drive gear portion 42 and rotates and drives a drive shaft 41. The drive shaft 41 rotates and drives a drive portion 40 disposed on the supporting member 35. Accordingly, the holding member shaft 31 to which the drive portion 40 is fixed is driven and rotated. The holding member position detection sensor 44 detects a position of the holding member 11 and with this detection, a position of the holding member 11 which is turned by the holding member rotating motor 43 is controlled.

If the holding member shaft 31 rotates, the holding member 11 can move from a sheet pressing position (solid lines in FIG. 8) to a retracting position (broken lines in FIG. 8) resisting a pressing force of the pressing spring 33. In the sheet pressing position, the holding member 11 gives a sheet pressing force by a spring force of the pressing spring 33.

The supporting member 35 is fixedly provided to a slide bush 50, and is thrustably supported with respect to a moving shaft 49 through the slide bush 50. Slide bushes 36 and 37 are fixed to both ends of the supporting member 35 in the longitudinal direction. The supporting member 35 can slide on slide rails 38 and 39 through the slide bushes 36 and 37. A timing belt 48 is fastened to a substantially central portion of the supporting member 35 in the longitudinal direction.

The holding member moving motor 45 transmits a driving force to a timing belt 48 through a drive portion 46. Accordingly, the supporting member 35 fixed to the timing belt 48 moves along the slide rails 38 and 39. A supporting member position detection sensor 51 detects a position of the supporting member 35 and with this detection, a position of the supporting member 35 moved by the holding member moving motor 45 is controlled.

If the supporting member 35 moves, the holding member 11 can rotate and move in the conveying direction. With this structure, it is possible to sort sheets such that rear ends of stacked sheets and a tip end of a sheet P1 which is conveyed next do not collide against each other while pressing the rear ends of the stacked sheet bundle even if the sheets have small size.

(Pair of Fold Rollers 810 and Pushing Member 830)

As illustrated in FIGS. 1 and 3, a pair of fold rollers 810*a* and 810*b* are provided downstream side of the stapler 820. A pushing member 830 is provided at a position opposed to the pair of fold rollers 810*a* and 810*b*. The pair of fold rollers 810*a* and 810*b* and the pushing member 830 constitute a folding portion.

A position of the pushing member 830 retracted from the storing guide 803 is a home position of the pushing member 830. If a motor M3 drives, the pushing member 830 projects toward an stored sheet bundle, and pushes the sheet bundle to nips of the pair of fold rollers 810*a* and 810*b*. Then, the pushing member 830 again returns to the home position. A pressure F1 which is sufficient for folding the sheet bundle is given between the pair of fold rollers 810*a* and 810*b* by a spring (not illustrated).

A sheet bundle folded by a pair of fold rollers 810 are discharged to the fold bundle tray 840 through a first pair of fold rollers 811*a* and 811*b* and a second pair of fold rollers 812*a* and 812*b*.

Pressures F2 and F3 which are sufficient to convey and stop a folded sheet bundle are applied between the first pair of fold rollers 811 and between the second pair of fold rollers 812.

A conveying guide 813 guides a sheet bundle between the pair of fold rollers 810 and the first pair of fold rollers 811. A conveying guide 814 guides a sheet bundle between the first pair of fold rollers 811 and the second pair of fold rollers 812. The pair of fold rollers 810, the first pair of fold rollers 811 and the second pair of fold rollers 812 nip a center-folded sheet bundle from both surfaces and rotate the sheets at equal speed by the same motor M4 (not illustrated).

The sheet bundle bound by the stapler 820 are folded after the sheet bundle are lowered by a predetermined distance from the position at the time of the staple process, and after the staple position of the sheet bundle is aligned with the nip position of the pair of fold rollers 810. Accordingly, the sheet bundle are folded around the stapled portion (bound portion).

A pair of alignment plates 815 align the widths of sheets stored in the storing guide 803, the pair of alignment plates 815 move the sheets in the nipping direction and position (align) the widthwise direction of the sheets by a motor M5.

A crease press unit 860 as a folding portion processing unit is provided downstream of a second pair of fold rollers 812. The crease press unit 860 includes a press holder 862 which supports a pair of press rollers 861. If the press holder 862 is moved toward the crease direction in a state where the pair of press rollers 861 nip the folded portion, the crease is reinforced. A first conveyer belt 849 is disposed directly below the crease press unit 860. A sheet bundle are conveyed to a second conveyer belt 842 from the first conveyer belt 849, and stacked on a discharge tray 843 from the second conveyer belt 842.

(Inserter 900)

Next, the inserter 900 provided on an upper portion of the finisher 500 will be described based on FIG. 1. The inserter 900 inserts a sheet (insert sheet) which is different from normal sheets to the top page, the last page or an intermediate page of sheets (recording sheets) formed with images in the printing portion 300. An insert sheet of the top page or the last page is a front cover sheet.

The inserter 900 feeds sheets which are set in insert trays 901 and 902 by a user to any of the sample tray 701, the stack tray 700 and the fold bundle tray 840 without through the printing portion 300. The inserter 900 separates a sheet bundle stacked on the insert trays 901 and 902 one-sheet by one-sheet, and sends the sheets to the conveying path 520 with desired timing.

(Control Portion)

Figure 11:
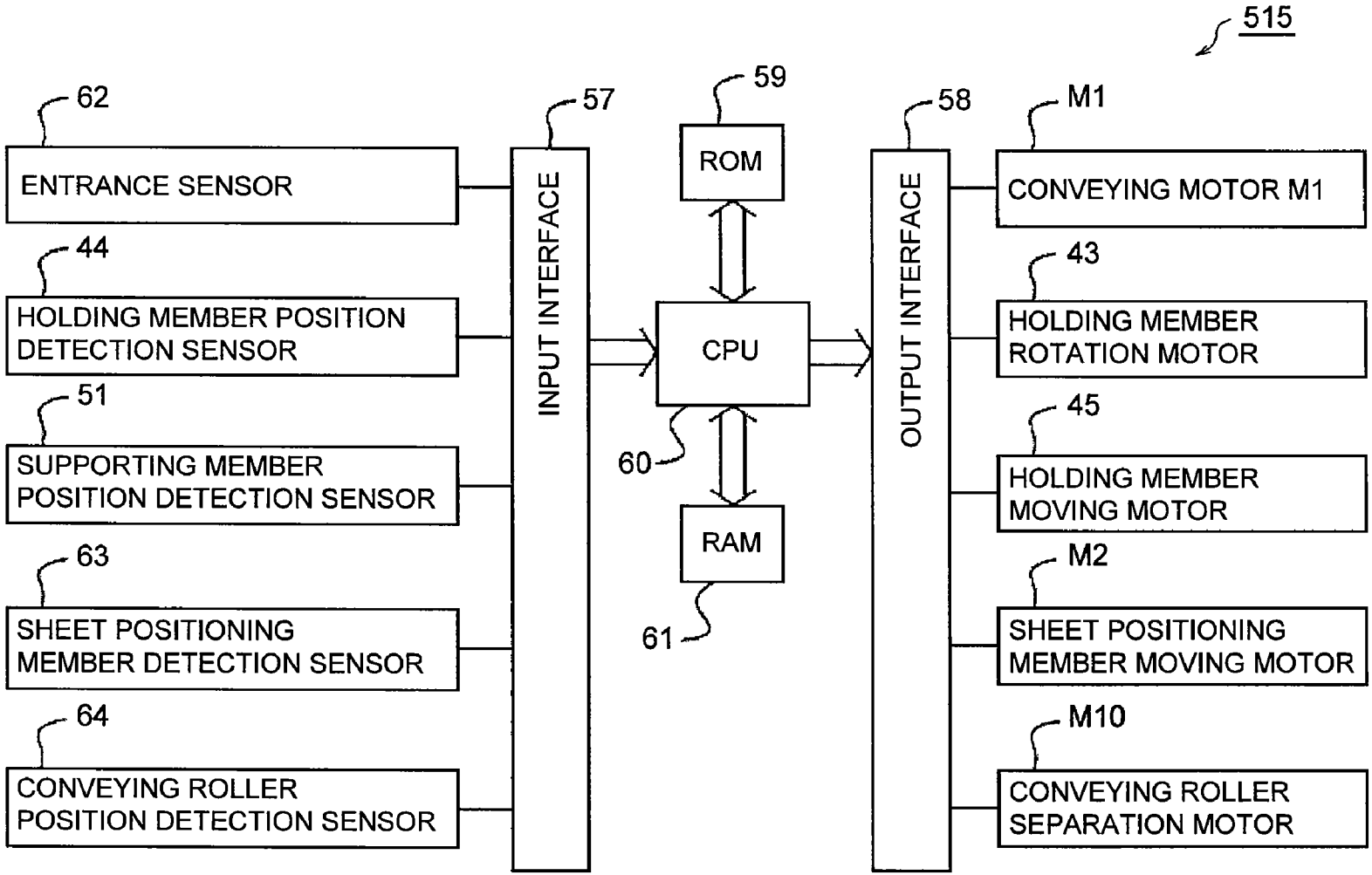
FIG. 11 is a control block diagram of a sheet postprocessing apparatus.

FIG. 11 is a function block diagram illustrating a structure of a finisher control portion 515 of the finisher 500.

The finisher control portion 515 is constituted by a microcomputer system, and includes a CPU 60, a ROM 59, and a RAM 61. A puncher processing program, a stapling processing program and the like are previously stored in the ROM 59. The CPU 60 executes the programs, exchanges appropriate data with the RAM 61, inputs data, thereby preparing predetermined control signals.

Detection signals from an inlet detection sensor 62, a pressure member position detection sensor 24, a holding member position detection sensor 44 and a sheet positioning member detection sensor 63 are input to the CPU 60 through an input interface circuit 57 as input data.

Various control signals are output from the CPU 60 through an output interface circuit 58. The output signals are sent to a control device such as a motor driver, control the control device, and operate the conveying motor M1, the pressure member drive motor 22, the holding member rotating member 43, a sheet positioning member moving motor M2 and a conveying roller separating motor M10. Data communication is sent and received between a CPU circuit portion 150 (see FIG. 12) provided on the side of the image forming apparatus main body and the CPU 60 of the finisher 500.

FIG. 12 is a control block diagram of the copying machine 1000. The CPU circuit portion 150 includes a CPU (not illustrated). The CPU circuit portion 150 controls an original feeding control portion 101, an image reader control portion 201, an image signal control portion 202, a printer control portion 301, a folding processing control portion 401, a finisher control portion 515, an external I/F 203. The CPU circuit portion 150 controls based on a control program stored in a ROM 151 and setting of the operation portion 1.

The original feeding control portion 101 controls the original feeding portion 100, the image reader control portion 201 controls the image reader 200, the printer control portion 301 controls the printing portion 300, and the folding processing control portion 401 controls the folding processing portion 400, respectively. The finisher control portion 515 controls the finisher 500, and the center-binding book-forming portion 800 controls the inserter 900, respectively.

The operation portion 1 includes a plurality of keys for setting various kinds of functions concerning image formation, and a display portion for displaying a setting state. The operation portion 1 outputs key signals corresponding to operations of the keys by a user to the CPU circuit portion 150, and displays corresponding information based on a signal from the CPU circuit portion 150.

The RAM 152 is used as an area in which control data is temporarily held, and as a work area of computation caused by control. The external I/F 203 is an interface between the copying machine 1000 and an external computer 204, develops print data from the computer 204 in a bit map image, and outputs the same to the image signal control portion 202 as image data. An original image which was read by the image sensor 109 is output from the image reader control portion 201 to the image signal control portion 202. The printer control portion 301 outputs image data from the image signal control portion 202 to an exposure controlling portion 110.

Sheet information and condition concerning kinds of sheets (plain paper, coated paper, special paper) and sheet size are input from the operation portion (operation panel) 1 of the image forming apparatus main body by a user's operation, and the CPU circuit portion 150 can obtain these sheet conditions and recognize them. Examples of the sheet conditions are the sheet size, rigidity, thickness, grammage, physical properties (surface properties) such as surface resistance and smoothness, and kinds of sheets such as punch paper and tab paper.

The control portion may be any of the sheet stacking apparatus (center-binding book-forming portion 800), the finisher 500 and the apparatus main body (printing portion 300).

(Holding Member 11 in Center-Binding Book-Forming Portion 800 and Conveying Operation of Sheets)

Next, the holding member 11 in the center-binding book-forming portion 800 and the conveying operation of sheets will be described using FIGS. 8 and 13.

Figure 13:
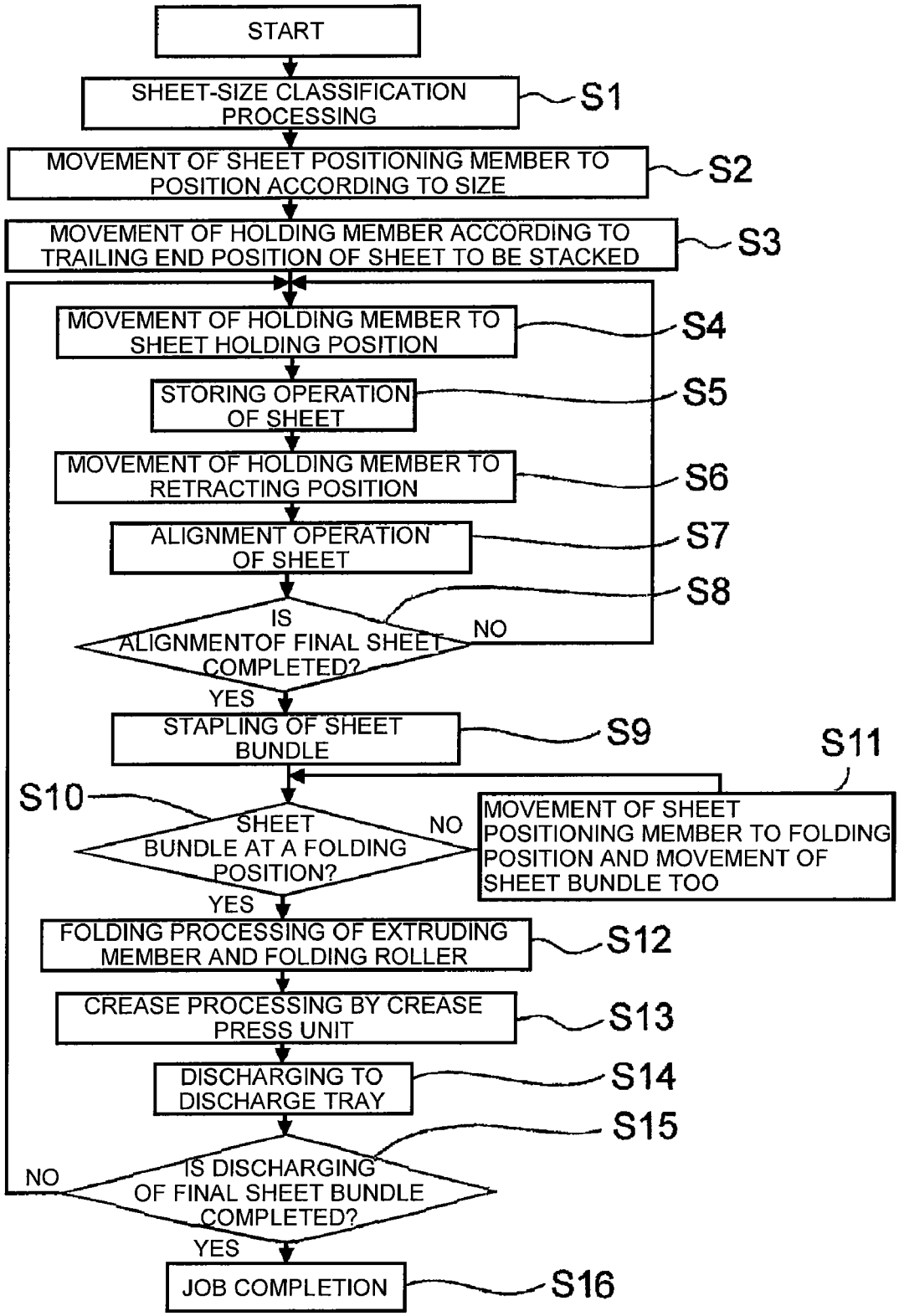
FIG. 13 is a flowchart of postprocessing apparatus.

As illustrated in FIG. 13, sheet size is classified (S1). Based on the classified sheet size, the sheet positioning member 805 moves to a position suitable for the size (S2). The holding member 11 moves in accordance with a position of a rear end of a sheet to be stacked (S3). The sheet holding member moves to a sheet pressing position (S4).

Figure 8A:
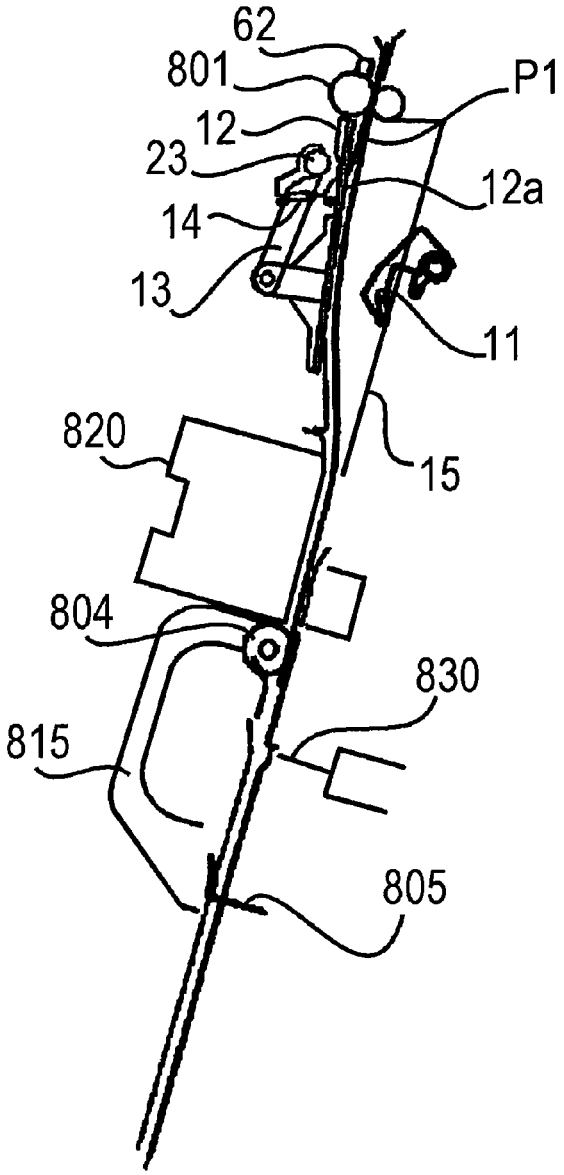
FIGS. 8A and 8B are explanatory diagrams of operation of the sheet processing apparatus.

As illustrated in FIG. 8A, a leading sheet P1 is delivered from the pair of saddle inlet rollers 801 to the conveying roller 804 (S5). At that time, the leading sheet P1 is located at a holding position for holding the leading sheet P1 stacked on the sheet stacking surface 15 of the storing guide 803.

Figure 8B:
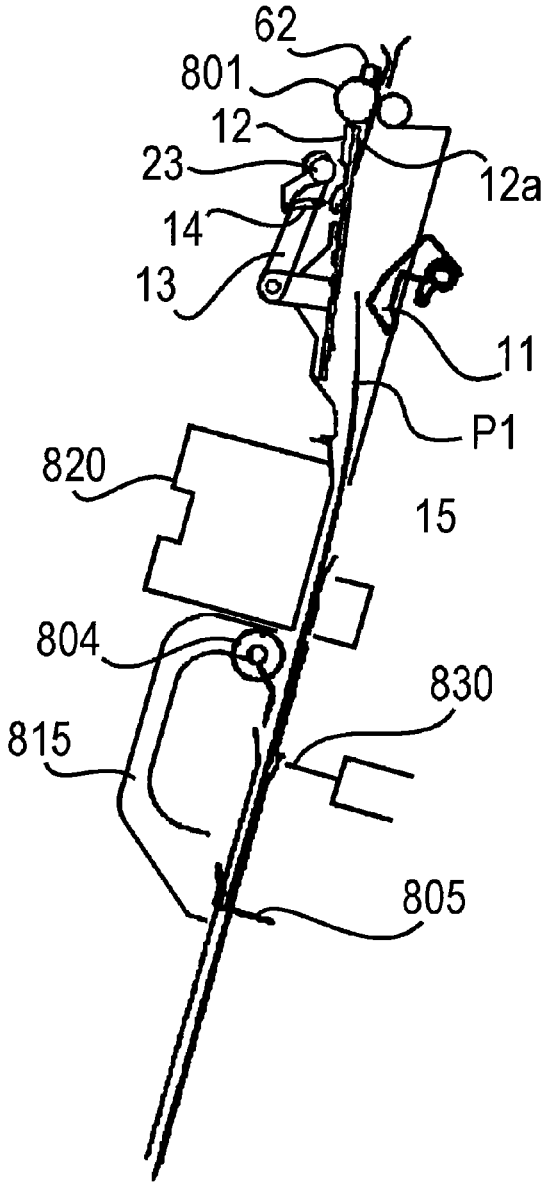

As illustrated in FIG. 8B, the leading sheet P1 is conveyed to the conveying roller 804 through the inlet detection sensor 62, and its tip end is conveyed to a portion near the sheet positioning member (tip end stopper) 805. After the rear end of the leading sheet P1 passes through the inlet detection sensor 62, the conveying roller 804 separates from the leading sheet P1 with predetermined timing.

Figure 9A:
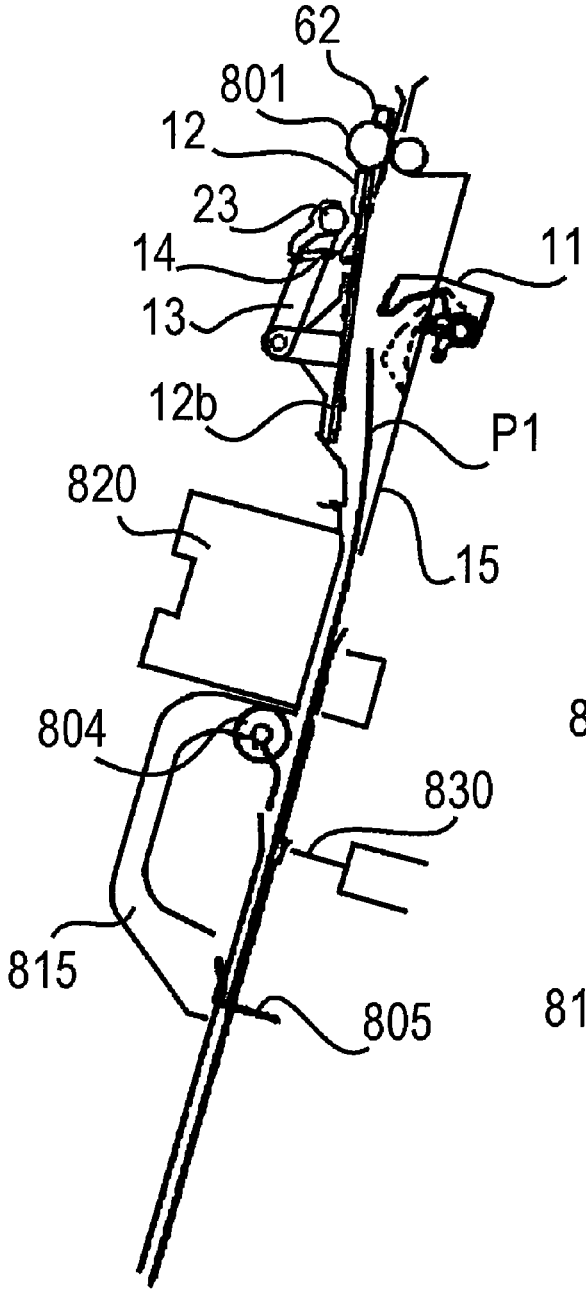
FIGS. 9A and 9B are explanatory diagrams of operation of the sheet processing apparatus.

As illustrated in FIG. 9A, after the conveying roller 804 separates from the leading sheet P1, the holding member 11 rotates to the retracting position (S6). In this state, the alignment operation in a direction intersecting with the conveying direction of sheets is carried out by the pair of alignment plates 815 (S7). The operations of S4 to S7 are repeated until the last sheet is aligned (S8).

Figure 9B:
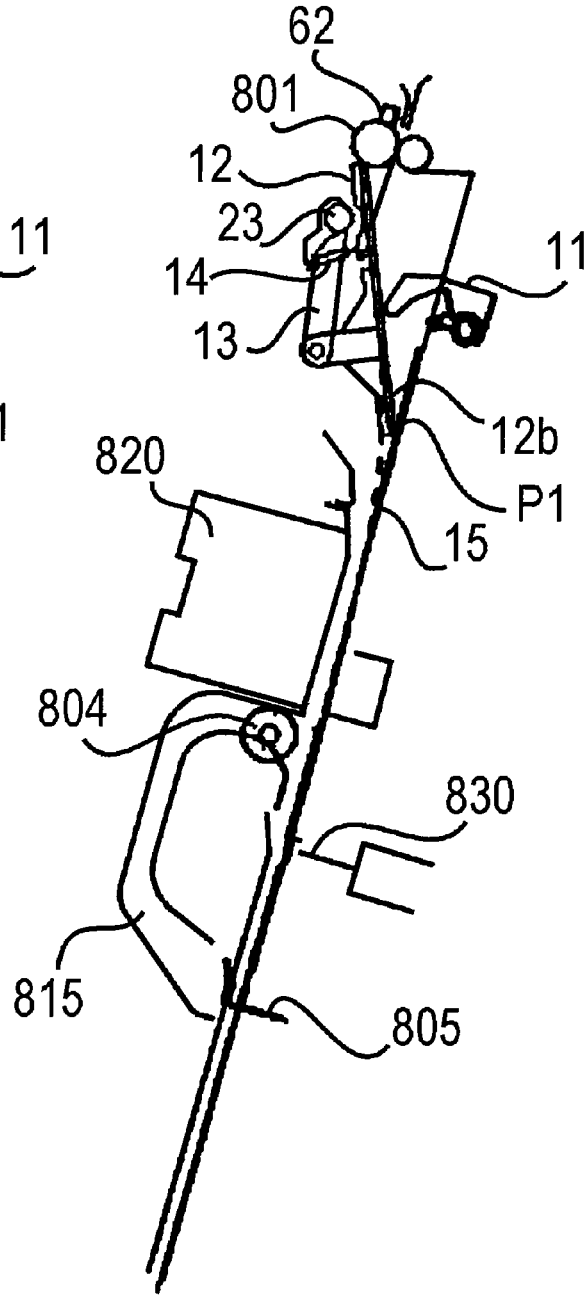

As illustrated in FIG. 9B, after the alignment operation is completed, the holding member 11 and the supporting member 13 start rotating to the holding position and the pressing position. Then, the lower portion 12*b* of the pressure member 12 first abuts against the sheet P1 (sheet stacking surface 15).

As illustrated in FIG. 1A, the supporting member 13 and the pressure member 12 further rotate, gradually push up the swell of the sheets upward from below and in this state, the supporting member 13 and the pressure member 12 apply a force to the sheet P1 toward the sheet stacking surface 15, and press the sheet P1. The lower portion 12*b* of the pressing surface 12*a* on the side of the sheet positioning member 805 abuts against the sheet P1, presses the sheet stacking surface 15 sequentially, the swell of the sheet P1 moves toward the end portion opposite from the sheet positioning member 805, and the swell is finally eliminated. Since the swell of the sheet P1 moves to the open end opposite from the sheet end, the entire sheets can be positioned and flattened reliably.

Figure 10A:
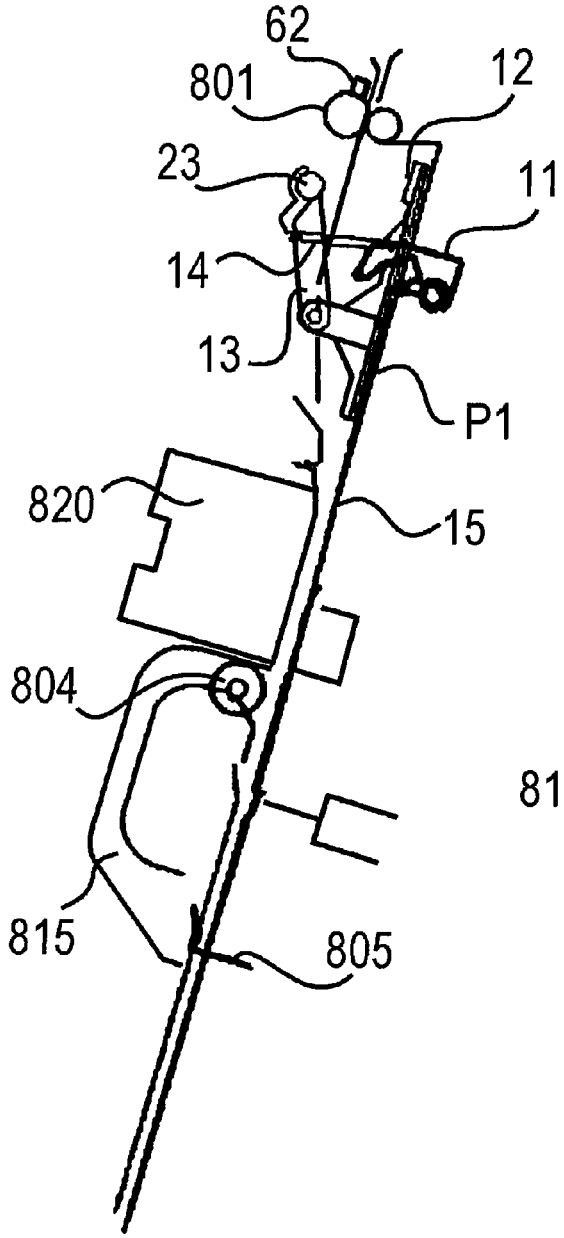
FIGS. 10A and 10B are explanatory diagrams of operation of the sheet processing apparatus.
Figure 10B:
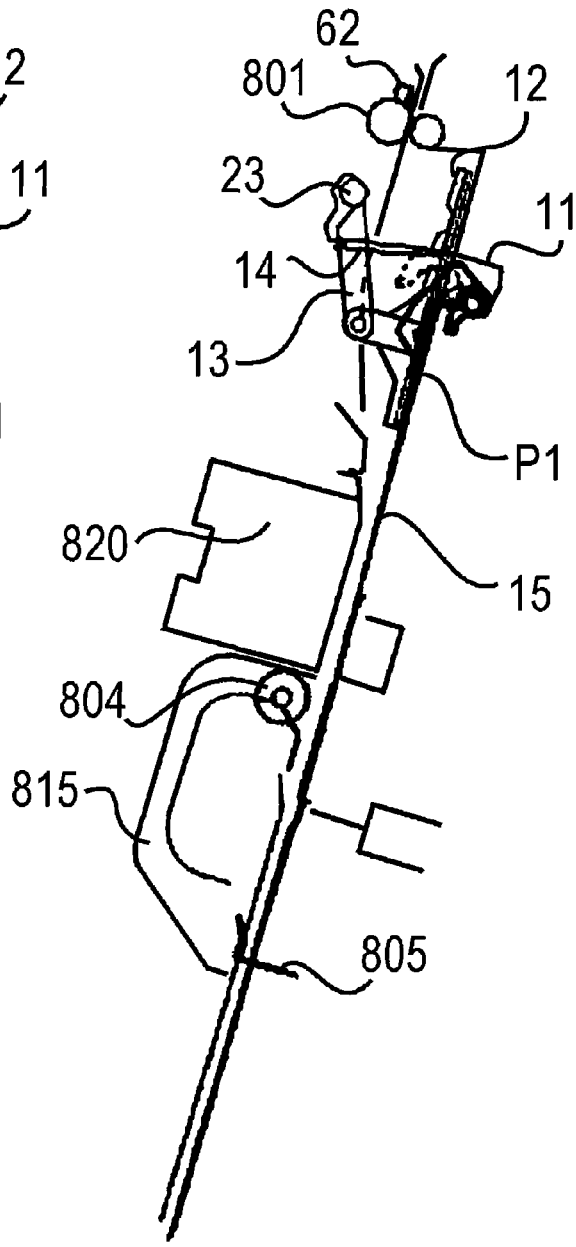

As illustrated in FIG. 10B, the holding member 11 rotates to the holding position in a state where the pressure member 12 presses the sheet P1, and the rear end portion of the sheet P1 is held. With the above operation, a predetermined number of sheets from the first sheet can be stacked.

With the above operation, also in a structure in which sheets are aligned by a substantially vertical storing guide 803, air in a stacked sheet bundle can be pushed up from below, and the air can gradually be removed from upper ends. Accordingly, a swell of a sheet, especially a swell formed by its own weight folding of weak sheet can be pushed upward from below and the swell can be removed. Therefore, it is possible to prevent a sheet bundle from partially swelling, and conveying failure and alignment failure of a sheet which is conveyed next can be suppressed. Since a swell of a sheet can reliably be removed, the holding member 11 can reliably hold a sheet.

A sheet bundle whose last sheet was aligned are stapled by the stapler 820 (S9). Then, it is detected whether the sheet bundle are located at the folding position (S10). When the sheet bundle are not located at the folding position, the sheet positioning member 805 is moved to the folding position, and the sheet bundle are moved to the folding position (S11).

When the sheet bundle are at the cease position, the pushing member 830 and the pair of fold rollers 810 carry out the folding processing (S12). Then, the crease process is carried out by the crease press unit 860 (S13). If the sheet bundle are subjected to the crease process, they are discharged to the discharge tray 843 (S14).

When the last sheet bundle have been discharged completely, the job is completed (S15 and S16). If the last sheet bundle have not yet been discharged completely, the procedure is returned to S4 (S15).

(Effect)

By providing the pressure member 12, it is possible to prevent a weak sheet from partially swelling, and to suppress the conveying failure and alignment failure of a sheet which is conveyed next. Thus, various sheets can be processed without conveying failure and alignment failure.

Since the storing guide 803 is substantially vertically inclined, the apparatus can be reduced in size in the lateral direction while suppressing the conveying failure and alignment failure, and the installation area of the apparatus can be reduced.

Since the pressure member 12 and the holding member 11 which are long in the conveying direction are provided, the limitation of sheet size is removed, and sheets of any size from small size to large size can be used.

Second Embodiment

A sheet stacking apparatus, a sheet processing apparatus and an image forming apparatus according to a second embodiment of the present invention will be described using drawings. Portions of the second embodiment which are similar to those of the first embodiment are designated with the same reference numerals and description thereof will not be described herein.

Figure 14A:
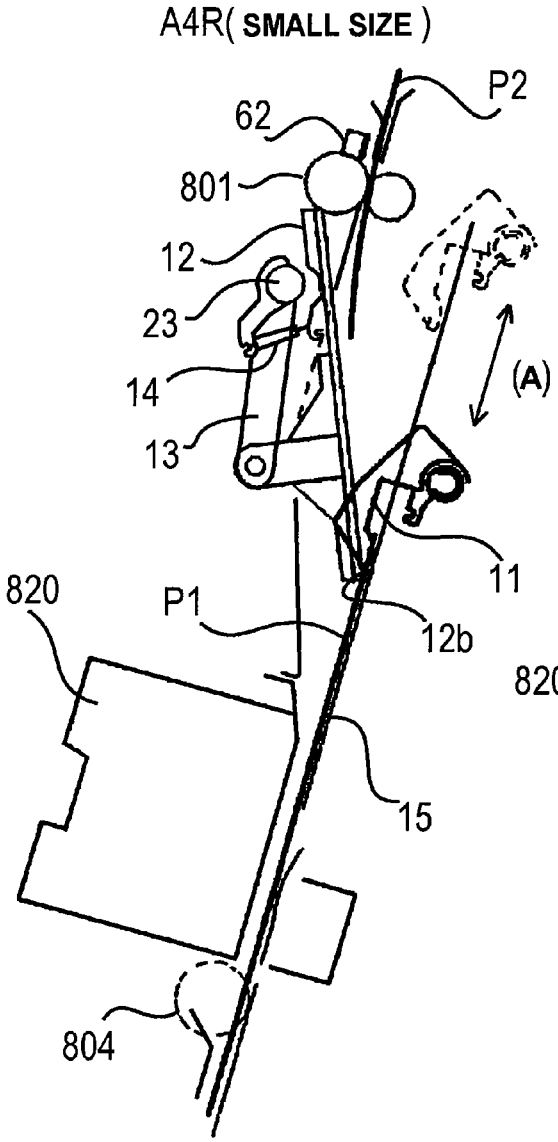
FIGS. 14A and 14B are explanatory diagrams of operation of a sheet processing apparatus according to a second embodiment.
Figure 14B:
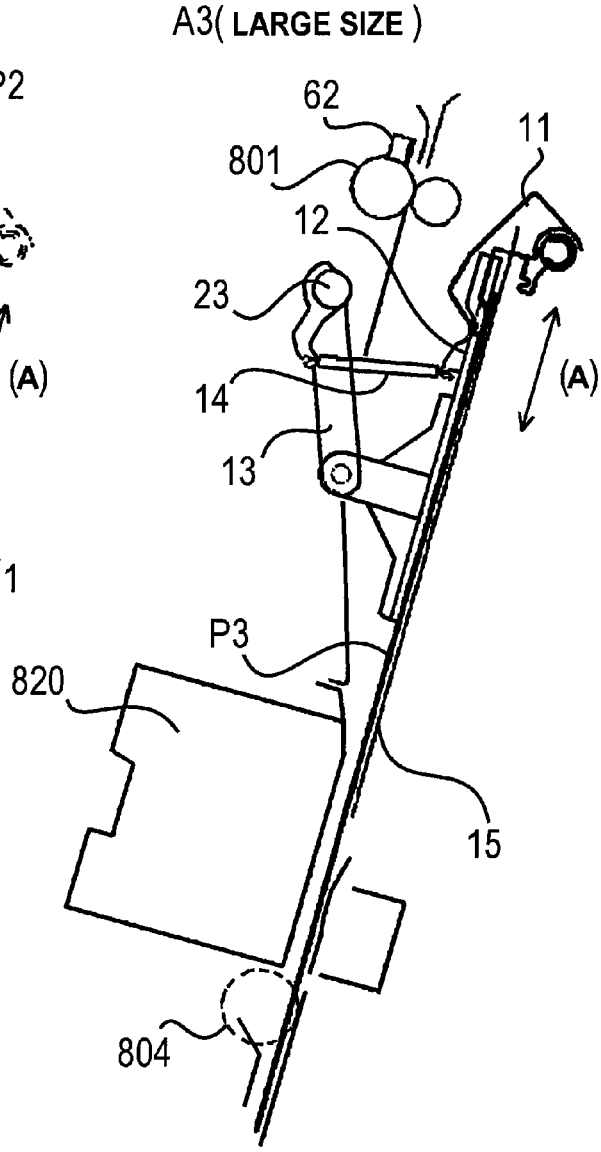

FIG. 14A is a diagram illustrating a pressing position of a sheet of small size. FIG. 14B is a diagram illustrating a pressing position of a sheet of large size. As illustrated in FIG. 14, according to the image forming apparatus of the second embodiment, in the image forming apparatus of the first embodiment, the pressing position is varied depending upon size of a sheet to be stacked.

As illustrated in FIG. 14B, large size has such a positional relation that the sheet is pressed in the entire pressing surface 12*a* of the pressure member 12. Therefore, the pressing surface 12*a* moves the pressure member 12 to a position where a sheet is pressed in accordance with the sheet stacking surface 15.

On the other hand, in the case of small size as illustrated in FIG. 14A, since a rear end of the sheet is located at a lower position, it is unnecessary to turn to a position where the sheet is pressed.

Figure 15:
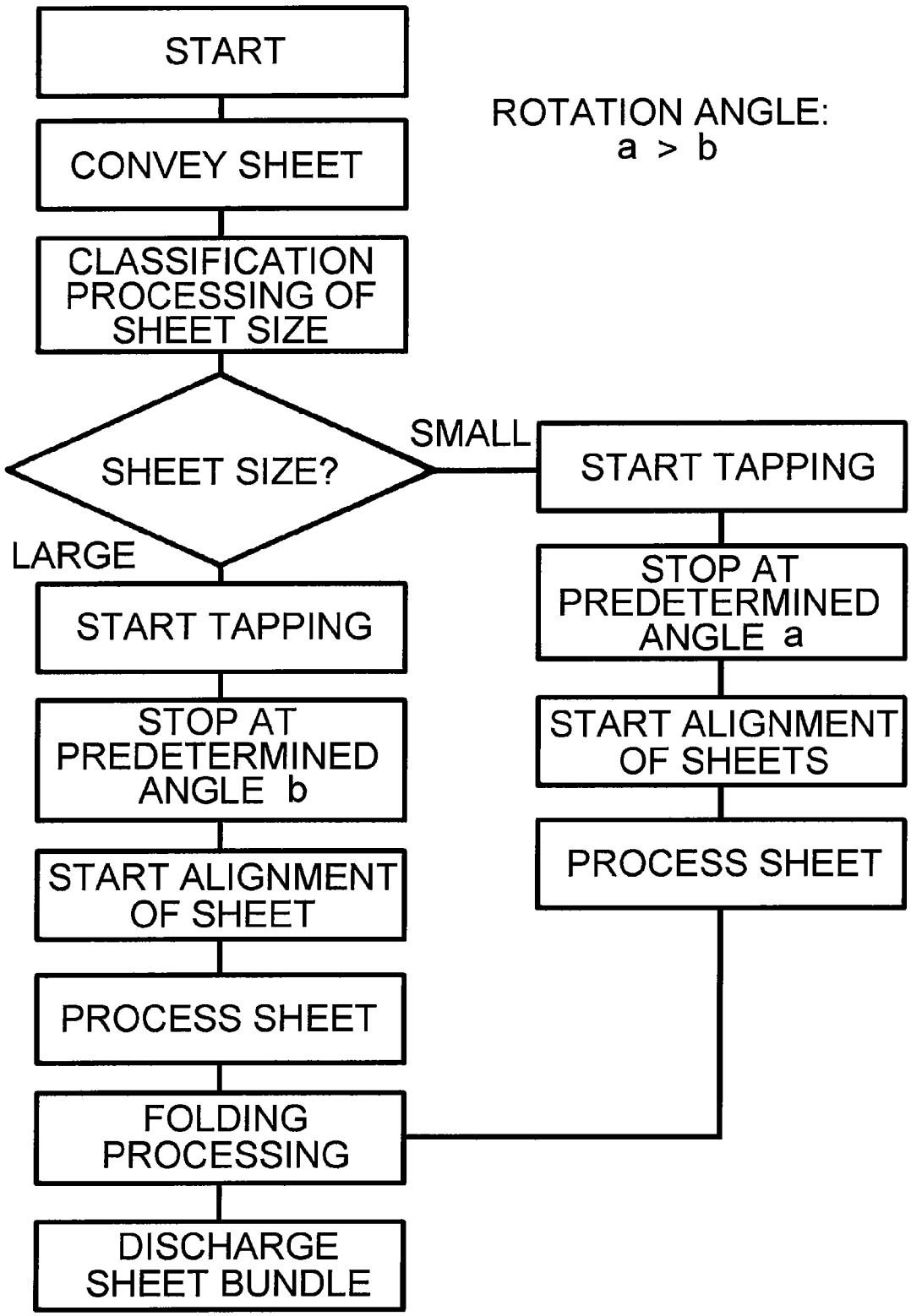
FIG. 15 is a flowchart of a postprocessing apparatus according to the second embodiment.
Figure 16:
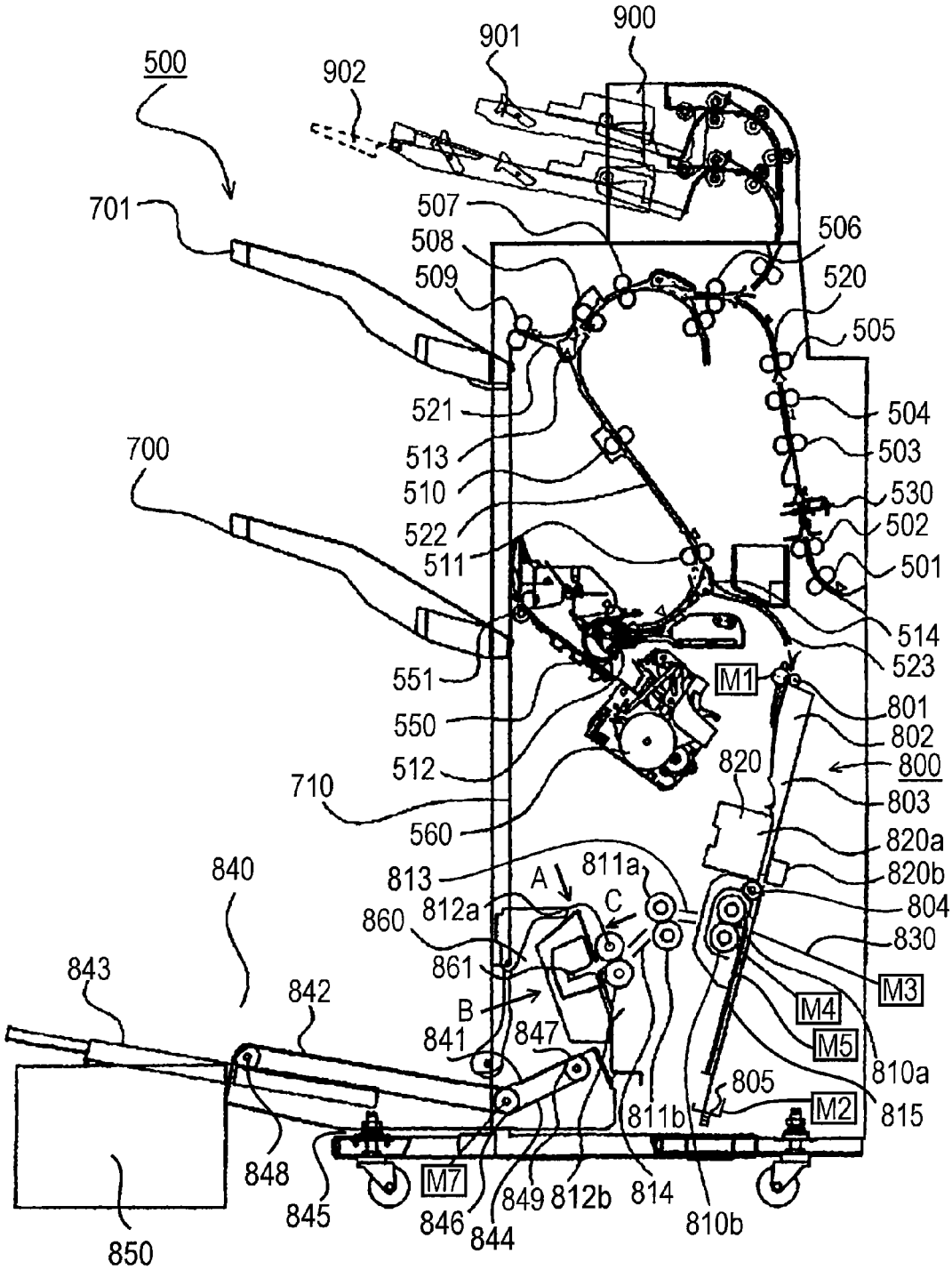
FIG. 16 PRIOR ART
FIG. 16 is a diagram illustrating a structure of a conventional sheet processing apparatus.
Figure 17A:
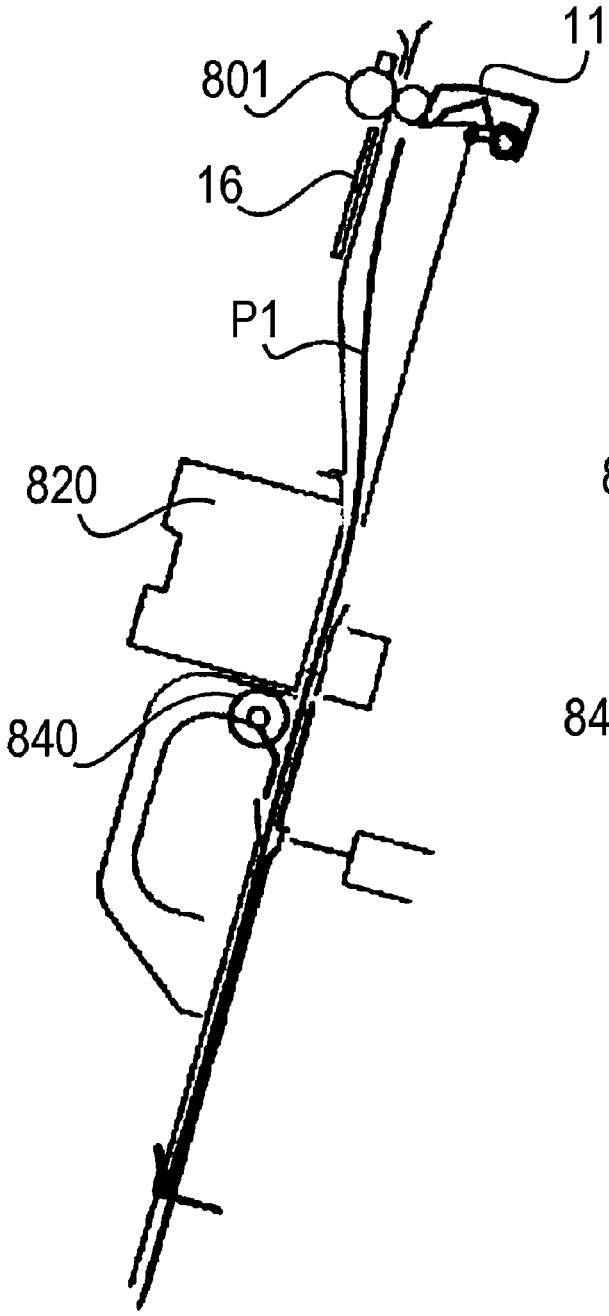
FIG. 17A PRIOR ART
FIGS. 17A and 17B are explanatory diagrams of operation of the conventional sheet processing apparatus.
Figure 17B:
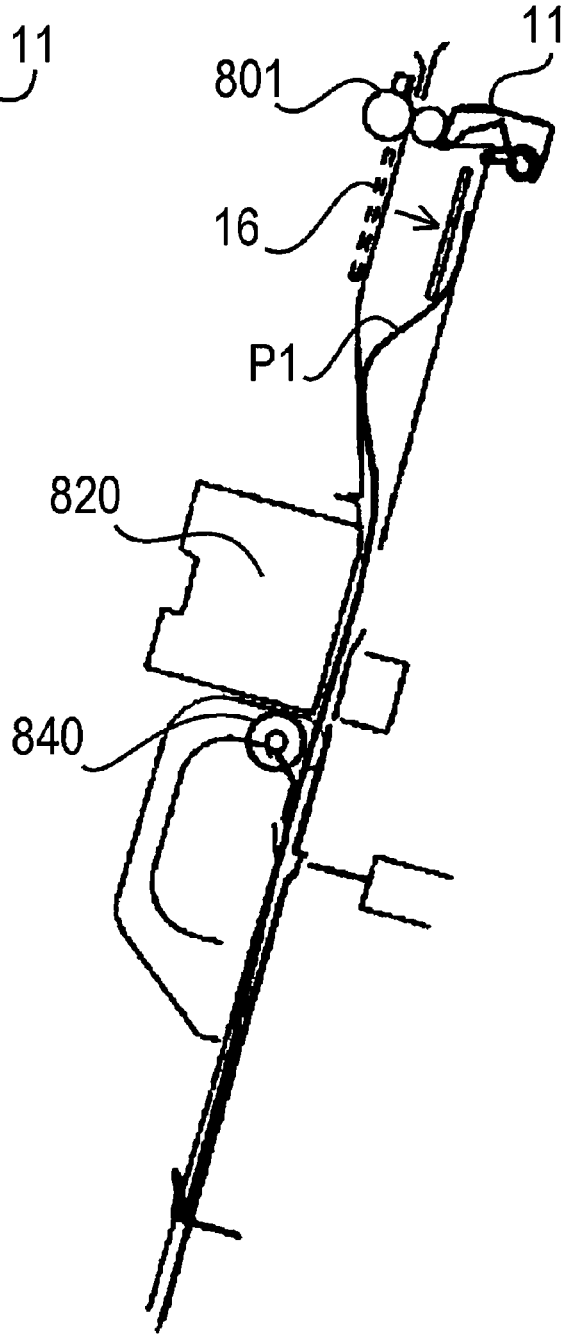
FIG. 17B PRIOR ART
Figure 18A:
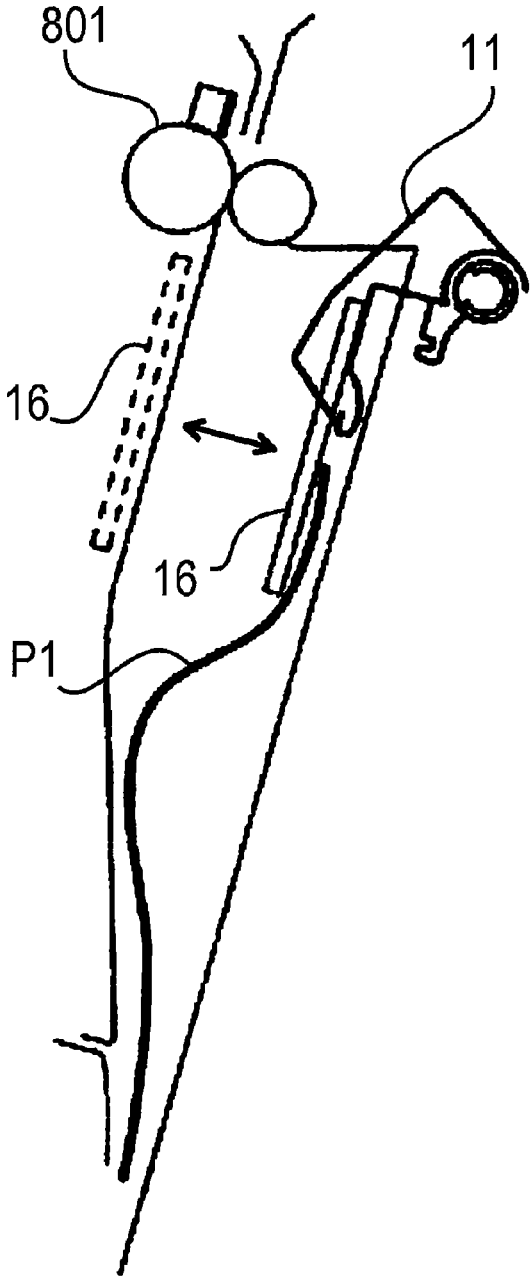
FIG. 18A PRIOR ART
FIGS. 18A and 18B are explanatory diagrams of operation of the conventional sheet processing apparatus.
Figure 18B:
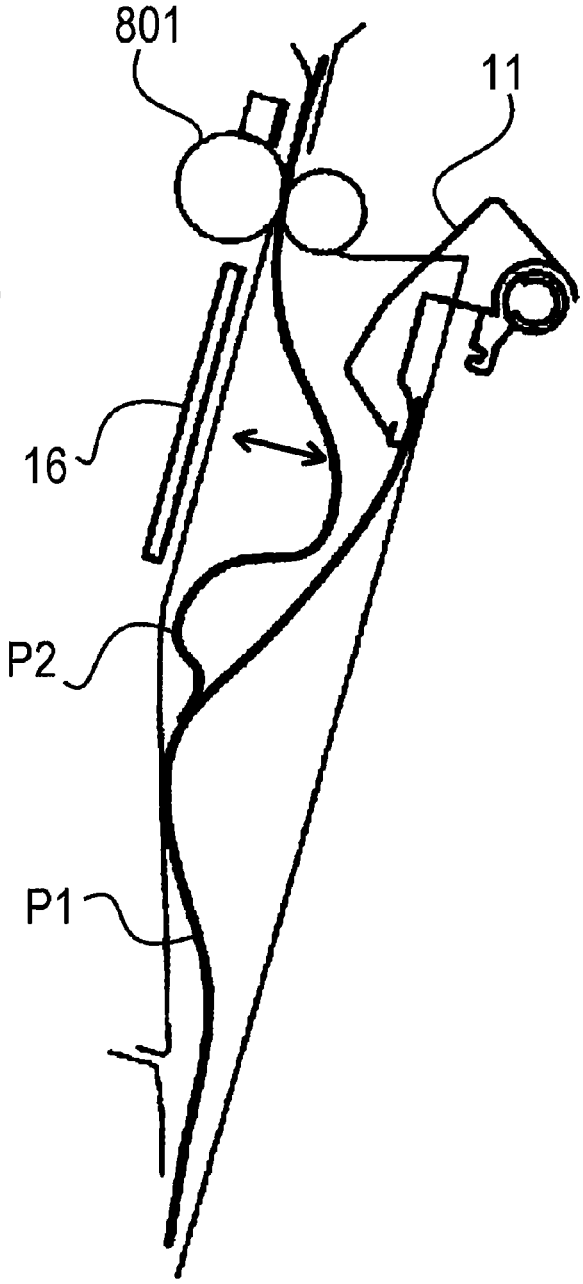
FIG. 18B PRIOR ART
Figure 19A:
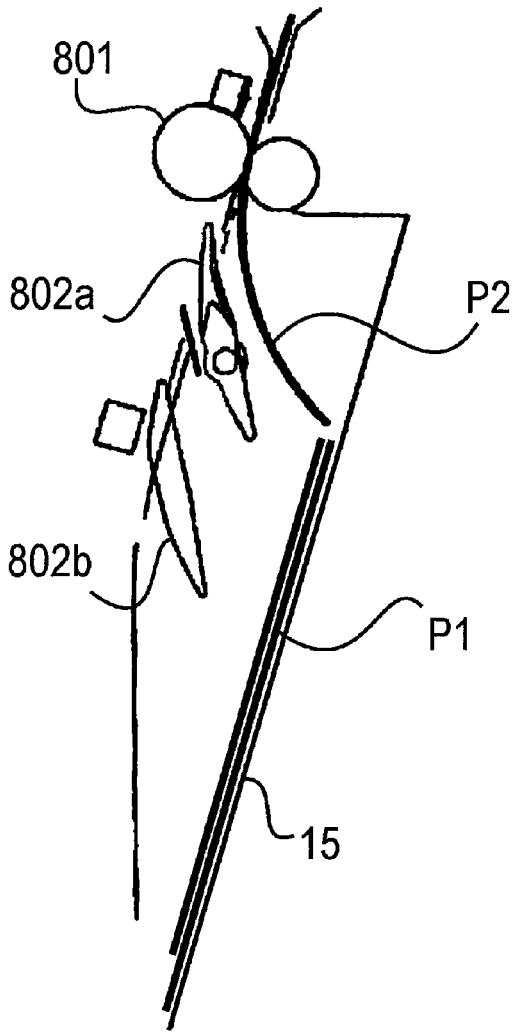
FIG. 19A PRIOR ART
FIGS. 19A and 19B are explanatory diagrams of operation of the conventional sheet processing apparatus.
Figure 19B:
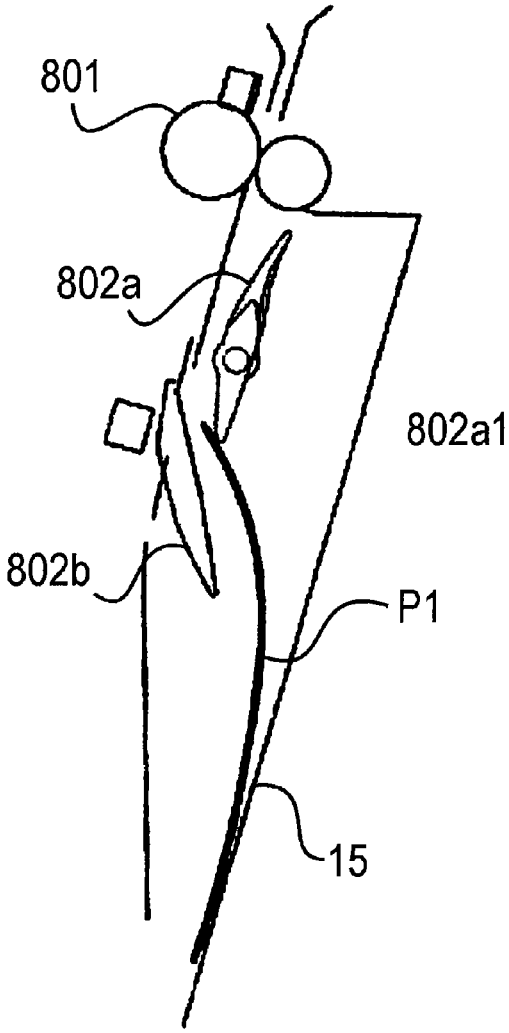
FIG. 19B PRIOR ART

That is, as illustrated in a flowchart in FIG. 15, in the case of the large size sheet, it is turned through a rotation motion angle $\beta$ of the supporting member 13, and in the case of the small size sheet, it is turned through a rotation motion angle $\alpha$ ($\alpha>\beta$) of the supporting member 13.

As illustrated in FIG. 14A, a tip end of a sheet P2 which is conveyed next is located at a position where the sheet can be conveyed into the sheet stacking portion (upstream end side of the pressure member 12 in the conveying direction is on the left side from the nip line of the saddle inlet roller 801 in FIG. 14A).

In the image forming apparatus, as the length of the sheet in the conveying direction is shorter, the productively can be enhanced. That is, an apparatus having higher productivity (processing time is shorter) is required for a small size sheet as compared with a large size sheet. The image forming apparatus of the present embodiment satisfies this requirement. That is, in the case of the small size sheet, since the rotation motion angle of the pressure member 12 and the supporting member 13 is set small, the processing time can be reduced, and even while a sheet is tapped, next sheet can be conveyed and the productivity can be enhanced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and function.

This application claims the benefit of Japanese Patent Application No. 2007-299899, filed Nov. 19, 2007, which is hereby incorporated by reference herein in its entirety.

What is claimed is:

1. A sheet stacking apparatus comprising:

a discharging member which is disposed in an upper portion of the sheet stacking apparatus and which discharges sheets;

a stacking member which stacks the sheets discharged downward from the discharging member;

a sheet positioning member, located on the downstream side of the stacking member in the discharging direction, which receives ends of the discharged sheets stacked on a stacking surface of the stacking member in a discharging direction of the sheet discharged by the discharging member; and a pressure member having a pressing surface which presses the sheet received by the sheet positioning member toward the stacking surface of the stacking member;

wherein at first a downstream side in the discharging direction of the pressing surface presses the discharged sheets toward the stacking surface of the stacking member, and subsequently an upstream side in the discharging direction of the pressing surface presses the discharged sheets toward the stacking surface sequentially.

2. The sheet stacking apparatus according to claim 1, wherein the stacking member is inclined such that a downstream side in the discharging direction of the discharged sheets becomes lower.

3. The sheet stacking apparatus according to claim 1, further comprises a holding member which holds upstream ends of the discharged sheets pressed by the pressure member in the discharging direction, and after the pressure member presses the discharged sheets, the holding member holds the upstream ends of the discharged sheets.

4. A sheet processing apparatus comprising:

a discharging member which is disposed in an upper portion of the sheet stacking apparatus and which discharges sheets;

a stacking member which stacks the sheets discharged downward from the discharging member;

a sheet positioning member, located on the downstream side of the stacking member in the discharging direction, which receives ends of the discharged sheets stacked on a stacking surface of the stacking member in a discharging direction of the sheet discharged by the discharging member;

a pressure member having a pressing surface which presses the sheet received by the sheet positioning member toward the stacking surface of the stacking member, wherein at first a downstream side in the discharging direction of the pressing surface presses the discharged sheets toward the stacking surface of the stacking member, and subsequently an upstream side in the discharging direction of the pressing surface presses the discharged sheets towards the stacking surface sequentially; and a processing unit which processes sheets stacked on the stacking member and pressed by the pressure member.

5. The sheet stacking apparatus according to claim 4, wherein the stacking member is inclined such that a downstream side in the discharging direction of the discharged sheets becomes lower.

6. The sheet stacking apparatus according to claim 4, further comprises a holding member which holds upstream ends of the discharged sheets pressed by the pressure member in the discharging direction, and after the pressure member presses the discharged sheets, the holding member holds the upstream ends of the discharged sheets.

7. An image forming apparatus comprising:

an image forming portion which forms an image on a sheet;

a discharging member which is disposed in an upper portion of the sheet stacking apparatus and which discharges sheets formed image by the image forming portion;

a stacking member which stacks the sheets discharged downward from the discharging member;

a sheet positioning member, located on the downstream side of the stacking member in the discharging direction, which receives ends of the discharged sheets stacked on a stacking surface of the stacking member in a discharging direction of the sheet discharged by the discharging member; and a pressure member having a pressing surface which presses the sheet received by the sheet positioning member toward the stacking surface of the stacking member;

wherein at first a downstream side in the discharging direction of the pressing surface presses the discharged sheets toward the stacking surface of the stacking member, and subsequently an upstream side in the discharging direction of the pressing surface presses the discharged sheets toward the stacking surface sequentially.

8. The sheet stacking apparatus according to claim 7, wherein the stacking member is inclined such that a downstream side in the discharging direction of the discharged sheets becomes lower.

9. The sheet stacking apparatus according to claim 7, further comprises a holding member which holds upstream ends of the discharged sheets pressed by the pressure member in the discharging direction, and after the pressure member presses the discharged sheets, the holding member holds the upstream ends of the discharged sheets.

* * * * *